US006315047B1

(12) United States Patent
Deaton et al.

(10) Patent No.: US 6,315,047 B1
(45) Date of Patent: Nov. 13, 2001

(54) ECCENTRIC SUBSURFACE SAFETY VALVE

(75) Inventors: Thomas M. Deaton; Jason C. Mailand, both of Huston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/398,699

(22) Filed: Sep. 20, 1999

Related U.S. Application Data

(60) Provisional application No. 60/101,209, filed on Sep. 21, 1998.

(51) Int. Cl.[7] ..... E21B 34/06

(52) U.S. Cl. ..... 166/319; 166/332.8

(58) Field of Search ..... 166/319, 321, 166/332.8, 334.1, 166, 322

(56) References Cited

U.S. PATENT DOCUMENTS

| | | | | |
|---|---|---|---|---|
| 3,233,677 | | 2/1966 | Myers . | |
| 3,763,932 | | 10/1973 | Dinning . | |
| 3,958,633 | | 5/1976 | Britch et al. . | |
| 3,980,135 | * | 9/1976 | Garrett | 166/322 |
| 4,457,376 | | 7/1984 | Carmody et al. . | |
| 4,527,631 | * | 7/1985 | Vazquez | 166/322 |
| 4,531,587 | | 7/1985 | Fineberg . | |
| 4,540,047 | | 9/1985 | Akkerman . | |
| 4,691,775 | | 9/1987 | Lustig et al. . | |
| 4,854,387 | | 8/1989 | Pringle . | |
| 4,926,945 | | 5/1990 | Pringle et al. . | |
| 4,986,358 | | 1/1991 | Lueders et al. . | |
| 5,125,457 | | 6/1992 | Meaders . | |
| 5,137,089 | | 8/1992 | Smith et al. . | |
| 5,263,847 | | 11/1993 | Akkerman et al. . | |
| 5,323,859 | | 6/1994 | Smith et al. . | |
| 5,358,053 | | 10/1994 | Akkerman . | |
| 5,411,096 | | 5/1995 | Akkerman . | |
| 5,465,786 | | 11/1995 | Akkerman . | |
| 5,682,921 | | 11/1997 | Rawson et al. . | |
| 5,752,569 | | 5/1998 | Bhavsar et al. . | |
| 5,823,265 | | 10/1998 | Crow et al. . | |
| 5,862,864 | * | 1/1999 | Whiteford | 166/321 |
| 5,918,858 | | 7/1999 | Rawson et al. . | |

FOREIGN PATENT DOCUMENTS

| | | |
|---|---|---|
| 2 278 866 A | 12/1994 | (GB) . |
| WO 00/17482 | 3/2000 | (WO) . |

* cited by examiner

*Primary Examiner*—David Bagnell
*Assistant Examiner*—Jennifer Dougherty
(74) *Attorney, Agent, or Firm*—Goldstein & Polasek

(57) ABSTRACT

The invention provides an eccentric subsurface safety valve that may include an eccentric body member having a thick side, a thin side, and a longitudinal bore therethrough. A closure member, such as a curved flapper, is mounted within the body member to control fluid flow through the longitudinal bore, and is moveable between an open and a closed position. The curved flapper may be disposed within a recess in the thick side of the eccentric body member when in its open position. A valve actuator, such as a flow tube, may be disposed within the body member and remotely shiftable to move the curved flapper between its open and closed positions. The flow tube may be shifted downwardly in response to movement of a piston. At least one return spring and/or a contained volume of pressurized gas may be provided to urge the flow tube away from the curved flapper. The piston may be connected to an eccentric plate slidably disposed about the flow tube and between a first and a second shoulder on the flow tube. A glide spring may be disposed about the flow tube and between the eccentric plate and one of the first and second flow tube shoulders to absorb forces imparted to the flow tube by the curved flapper upon closing. The present invention allows an increase in the inside diameter of the valve without increasing the outside diameter of the valve.

51 Claims, 34 Drawing Sheets

ECCENTRIC SUBSURFACE SAFETY VALVE

RELATED APPLICATIONS

This application claims the benefit of U.S. Provisional Application No. 60/101,209, filed Sep. 21, 1998.

BACKGROUND OF THE INVENTION

1. Field of the Invention

The present invention relates to subsurface well equipment and, more particularly, to an eccentric subsurface safety valve having a curved flapper.

2. Description of the Related Art

As is well known, after an oil and gas well is drilled, casing is cemented in place therein, and a string of production tubing, including various downhole tools (the combination of which is generally referred to as a "well completion") is disposed within the casing and used to produce hydrocarbons to the earth's surface. Historically, oil and gas producing companies have been interested in drilling small diameter wells that utilize the largest possible production tubing within the casing. This strategy allows the company to lower drilling costs, by drilling a smaller hole, and maximize profits, by the use of large production diameters. To gain the full potential of a well and maximize serviceability, all internal restrictions within the production tubing must be minimized throughout the completion.

A standard downhole well tool in well completions is a subsurface safety valve, which is commonly used to prevent uncontrolled fluid flow through the well in the event of an emergency, such as to prevent a well blowout. In a typical well completion, the subsurface safety valve is located near the top of the completion. As such, it becomes necessary that the internal diameter of the valve be as large as possible so as to enable passage of various well tools through the valve to other components below the valve. This large internal diameter requirement for the valve coupled with commercial incentives to reduce the inside diameter of the support casing creates a restrictive design envelope for the valve. If the outside diameter of the valve is just below the inside diameter of the casing and a flat flapper is used as the sealing mechanism in the valve, then the inside diameter of the valve is limited by geometric considerations, as is well known in the art. For some completions, the resulting inside diameter is unacceptable. In an effort to increase inside diameters, curved flapper valves were developed. However, the industry continues to move towards the use of tubing and casing having larger and larger diameters. For example, with the advent of directional drilling, the industry has recognized the economic advantages of drilling one relatively large, generally vertical, main well bore, and then directionally drilling and completing multiple lateral wells therefrom. Use of multiple lateral wells stemming from a main well is also environmentally advantageous in that it results in less disturbance to the earth's surface, or a smaller "footprint," as compared to the relatively large disturbance/footprint when drilling and completing numerous individual vertical wells of the traditional type. The movement towards use of these larger diameters has given rise to a need in the industry for a subsurface safety valve wherein the outer diameter of the valve remains constant, or of a heretofore standard dimension, but wherein the inside diameter of the valve is increased.

SUMMARY OF THE INVENTION

The present invention has been contemplated to meet the above described needs. In one aspect, the present invention is an eccentric subsurface safety valve for controlling fluid flow in a well conduit that may include an eccentric body member having a thick side, a thin side, and a longitudinal bore extending therethrough. A closure member, such as a curved flapper, is mounted within the body member to control fluid flow through the longitudinal bore, and is moveable between an open and a closed position. The curved flapper may be disposed within a recess in the thick side of the eccentric body member when the curved flapper is in its open position. A valve actuator, such as a flow tube, is disposed within the body member and is remotely shiftable to move the curved flapper between open and closed positions. The flow tube may be shifted downwardly in response to movement of a piston, which may be disposed within the thick side of the eccentric body member. The piston may be moved by application of hydraulic fluid. At least one return spring and/or a contained volume of pressurized gas may be provided to urge the flow tube away from the curved flapper. The piston may be connected to an eccentric plate sidably disposed about the flow tube and between a first and a second shoulder on the flow tube. A glide spring, such as a wave spring, may be disposed about the flow tube and between the eccentric plate and one of the first and second shoulders on the flow tube to cushion or absorb forces imparted to the flow tube by the curved flapper upon closing. The at least one return spring may be disposed about at least one spring rod, and may be contained between a retaining flange on the spring rod and a locking flange on a lockout sleeve. The at least one spring rod may be connected to the eccentric plate. The at least one return spring may be contained within at least one spring bore, which may be disposed in the thick side of the eccentric body member. The present invention allows an increase in the inside diameter of the valve without increasing the outside diameter of the valve.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
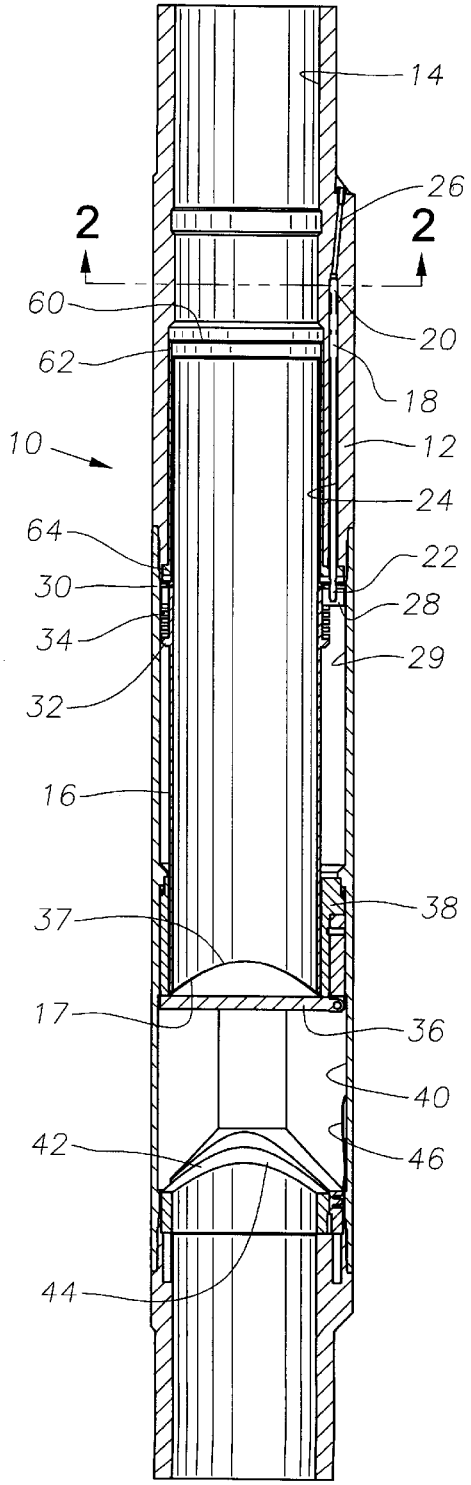
FIG. 1 is a longitudinal cross-sectional view of the eccentric subsurface safety valve of the present invention.
Figure 2:
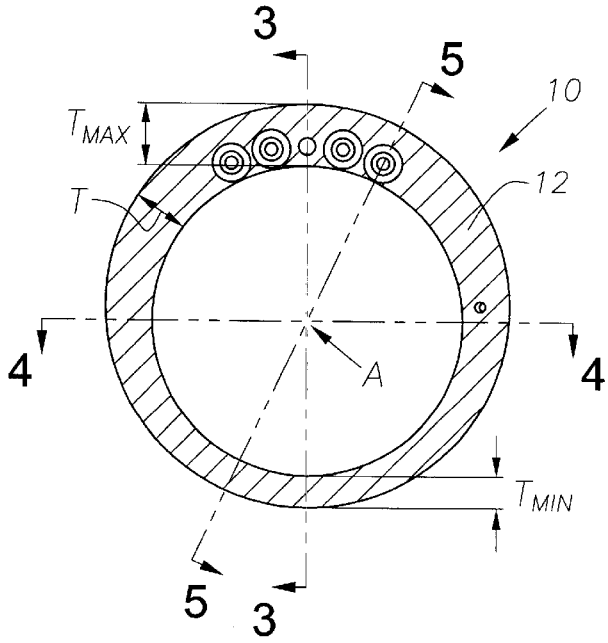
FIG. 2 is a cross-sectional view taken along line 2—2 of FIG. 1.

Referring to the drawings in detail, wherein like numerals denote identical elements throughout the several views, the subsurface safety valve of the present invention is referred to by the numeral 10. Reference will primarily be made to FIGS. 1–5, but reference may be easily made to the larger-scale views of FIGS. 6–13 for clarity, if desired. As best shown in FIG. 2, the valve 10 includes an eccentric body 12 having a longitudinal bore 14 therethrough. The eccentric body 12 has a variable wall thickness T, with a maximum wall thickness $T_{max}$ and a minimum wall thickness $T_{min}$ being positioned directly opposite one another and on a line of symmetry, which coincides with section line 3—3 of FIG. 2. For purposes of this patent, the term "line of symmetry" or "symmetry line" shall refer to a line extending through a center axis A of the longitudinal bore 14, and through the eccentric body 12 such that the cross-sectional areas of the eccentric body 12 on opposite sides of the symmetry line are symmetrical. The eccentric body 12 also includes a "thick" side and a "thin" side. The maximum wall thickness $T_{max}$ is disposed in the thick side, and the minimum wall thickness $T_{min}$ is disposed in the thin side. The thick and thin sides are separated by an asymmetry line, which coincides with section line 4—4 of FIG. 2. For purposes of this patent, the term "line of asymmetry" or "asymmetry line" shall refer to a line that is perpendicular to the symmetry line 3—3, and extends through the center axis A of the longitudinal bore 14 and through the eccentric body 12.

The valve 10 also includes a valve actuator or tubular sleeve member 16 (sometimes referred to as a flow tube), which is disposed for longitudinal movement within the longitudinal bore 14 of the eccentric body 12. The flow tube 16 may be movable in response to movement of a piston 18 having a first end 20 and a second end 22. The piston 18 is movably disposed within a cylinder 24 in the eccentric body 12. The cylinder 24 is preferably disposed in the thick side of the eccentric body 12. In another specific embodiment, the cylinder 24 may be disposed so as to intersect the symmetry line 3—3. The cylinder 24 and the first end 20 of the piston 18 are in fluid communication with a fluid passageway 26 for establishing fluid communication with a control conduit (not shown) running from the earth's surface, in a manner well known to those of ordinary skill in the art. The second end 22 of the piston 18 is connected (e.g., by threads) to an eccentric plate 28 (see FIG. 6B) which is disposed around the flow tube 16, and is movably disposed within a first, or plate, recess 29 in the thick side of the eccentric body 12. In a specific embodiment, the eccentric plate 28 may be fixedly connected to the flow tube 16. In another specific embodiment, with reference to FIG. 6B, the eccentric plate 28 may be slidably disposed around the flow tube 16 and between a first and a second shoulder 30 and 32 on the flow tube 16. In this specific embodiment, a glide spring 34, such as a wave spring, may be disposed around the flow tube 16, and between the eccentric plate 28 and one of the first and second shoulders 30 and 32. The purpose of the glide spring 34 will be explained below.

Figure 3A:
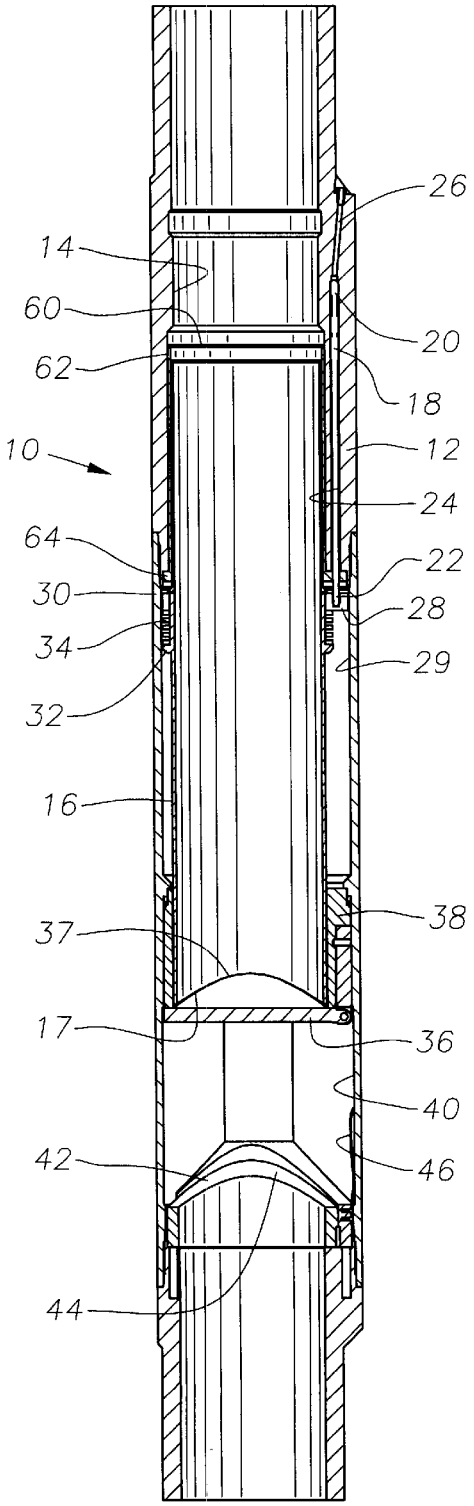
FIG. 3A is a longitudinal cross-sectional view taken along line 3—3 of FIG. 2, and illustrates the valve in a closed position.
Figure 3B:
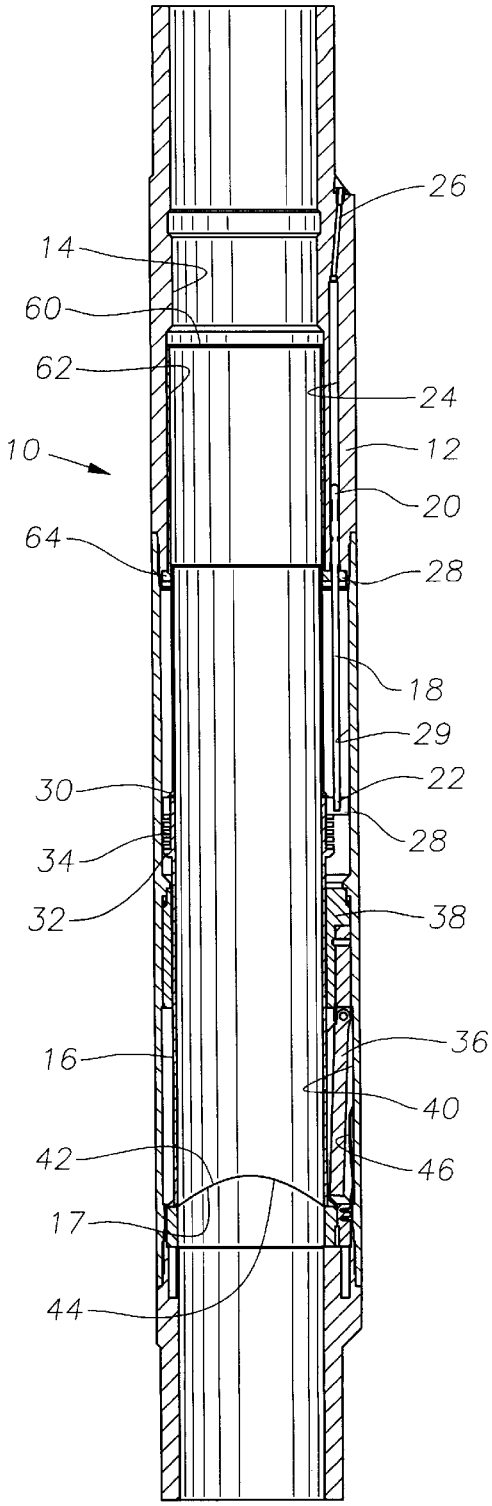
FIG. 3B is a longitudinal cross-sectional view taken along line 3—3 of FIG. 2, and illustrates the valve in an open position.

Upon application of pressurized fluid from the control conduit (not shown) through the fluid passageway 26 to the first end 20 of the piston 18, the piston 18 will be forced downwardly within the cylinder 24, thereby moving the eccentric plate 28 and the flow tube 16 downwardly within the longitudinal bore 14 of the eccentric body 12 and against a preferably curved closure member 36, such as a curved flapper. The curved flapper 36 may by any type of curved flapper known to those of ordinary skill in the art, such as the curved flapper shown and described in U.S. Pat. No. 4,926,945 , which is commonly assigned hereto and incorporated herein by reference. The flow tube 16 includes a contoured lower surface 17 for mating with the contoured upper surface 37 of the curved flapper 36. The curved flapper 36 is hingedly attached to the eccentric body 12, or to an eccentric housing 38 that may form part of the eccentric body 12, and is biased into a closed position by a hinge spring (not shown) so as to restrict fluid flow through the longitudinal bore 14. The thick side of the eccentric body 12 includes a second recess 40 in which the curved flapper 36 is disposed when moved to an open position, as shown in FIGS. 3B, 4B and 5B. By providing the valve 10 with the eccentric body 12, it is possible to provide a space (i.e., the second recess 40) to house the curved flapper 36 when in the open position, and to do so without making any sacrifice in terms of increasing the outside diameter of the valve 10 while at the same time increasing the inside diameter of the valve 10. When the curved flapper 36 is in its open position (e.g., FIG. 3B), the contoured lower surface 17 of the flow tube 16 seals against a mating contoured sealing surface 42 on a nose seal 44 mounted below the curved flapper 36 within the safety valve 10, as more fully explained in U.S. Pat. No. 4,926,945. An upstanding biasing member 46 (e.g., a leaf spring) may be attached to the nose seal 44 (or to the eccentric housing 38) to urge the curved flapper 36 towards its closed position after hydraulic pressure is removed from the control conduit (not shown) and the flow tube 16 is retracted upwardly.

Figure 5A:
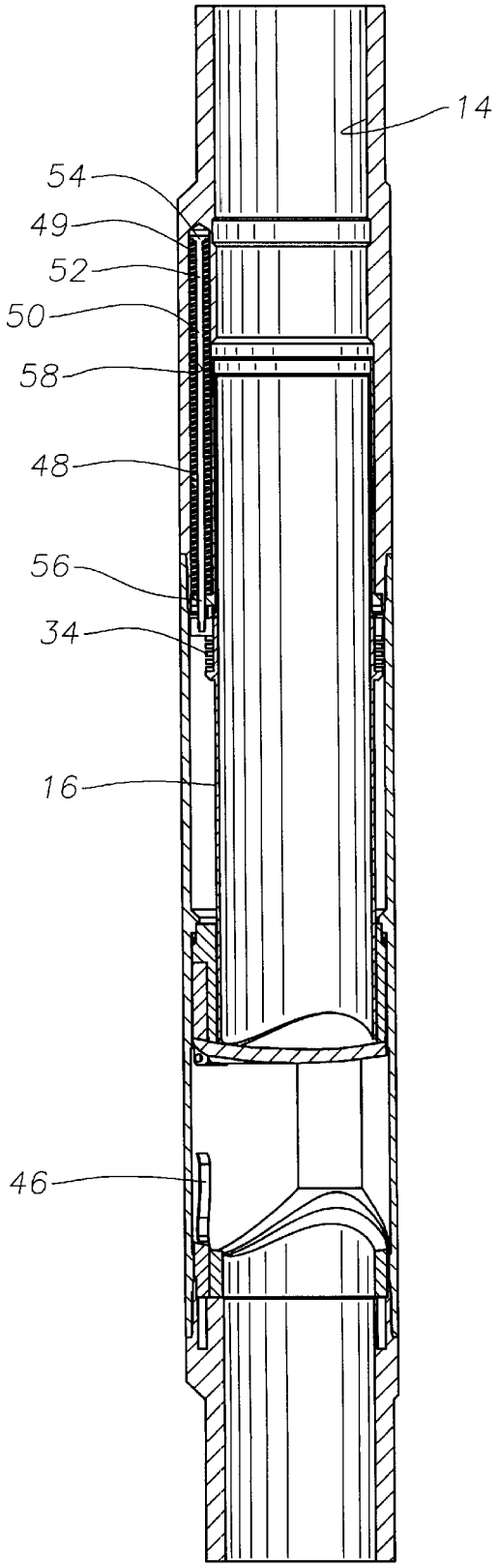
FIG. 5A is a longitudinal cross-sectional view taken along line 5—5 of FIG. 2, and illustrates the valve in the closed position.

The valve 10 is provided with a mechanism to bias the flow tube 16 away from the curved flapper 36 when pressurized fluid is removed from the piston 18. In a specific embodiment, as best shown in FIGS. 5A and 5B, the valve may include at least one return spring 48 disposed about at least one spring rod 50. With reference to FIG. 2, in this specific embodiment, the valve 10 is provided with four return springs and four spring rods. The number of return springs and spring rods, however, should not be taken as a limitation. A first end 52 of the spring rod 50 includes a retaining flange 54 for retaining a first end 49 of the return spring 48. A second end 56 of the spring rod 50 is connected (e.g., by threads) to the eccentric plate 28. In a specific embodiment, the at least one return spring 48 and spring rod 50 may be disposed within at least one spring bore 58 in the eccentric body 12. The at least one spring bore 58 is preferably disposed within the thick side of the eccentric body 12.

A lockout sleeve 60 having a tubular member 62 and a locking flange 64 is disposed within the valve 10. The tubular member 62 is disposed within the longitudinal bore 14 and around the flow tube 16. The locking flange 64 is connected to the eccentric body 12 and supports a second end 51 of the at least one return spring 48. The locking flange 64 also includes an appropriate number of openings through which the piston 18 and the at least one spring rod 50 pass to enable connection to the eccentric plate 28.

With reference to FIGS. 5A and 5B, in operation, as the flow tube 16 is forced downwardly from the closed position (FIG. 5A) to the open position (FIG. 5B), the eccentric plate 28 will pull the spring rod(s) 50 downwardly, and the return spring(s) 48 will be compressed between the locking flange 64 and the retaining flange(s) 54 at the first end(s) 52 of the spring rod(s) 50, while the second end(s) 56 of the spring rod(s) 50 are carried downwardly by the eccentric plate 28. When fluid pressure is removed from the piston 18 (see, e.g., FIG. 1), the return spring(s) 48 will rapidly retract the flow tube 16 and the curved flapper 36 will rapidly swing to its closed position under the combined force of its hinge spring (not shown) and well fluid pressure below the curved flapper 36. As the curved flapper 36 rapidly swings to its closed position, it is possible for it to maintain contact with, and even push, the flow tube 16 upwardly, which could result in deformation to the flow tube 36. To reduce or eliminate the chance of such deformation occurring, the glide spring 34 is disposed around the flow tube 16 (as described above) in order to cushion or absorb the forces applied to the flow tube 16 by the curved flapper 36 upon closing.

Figure 14:
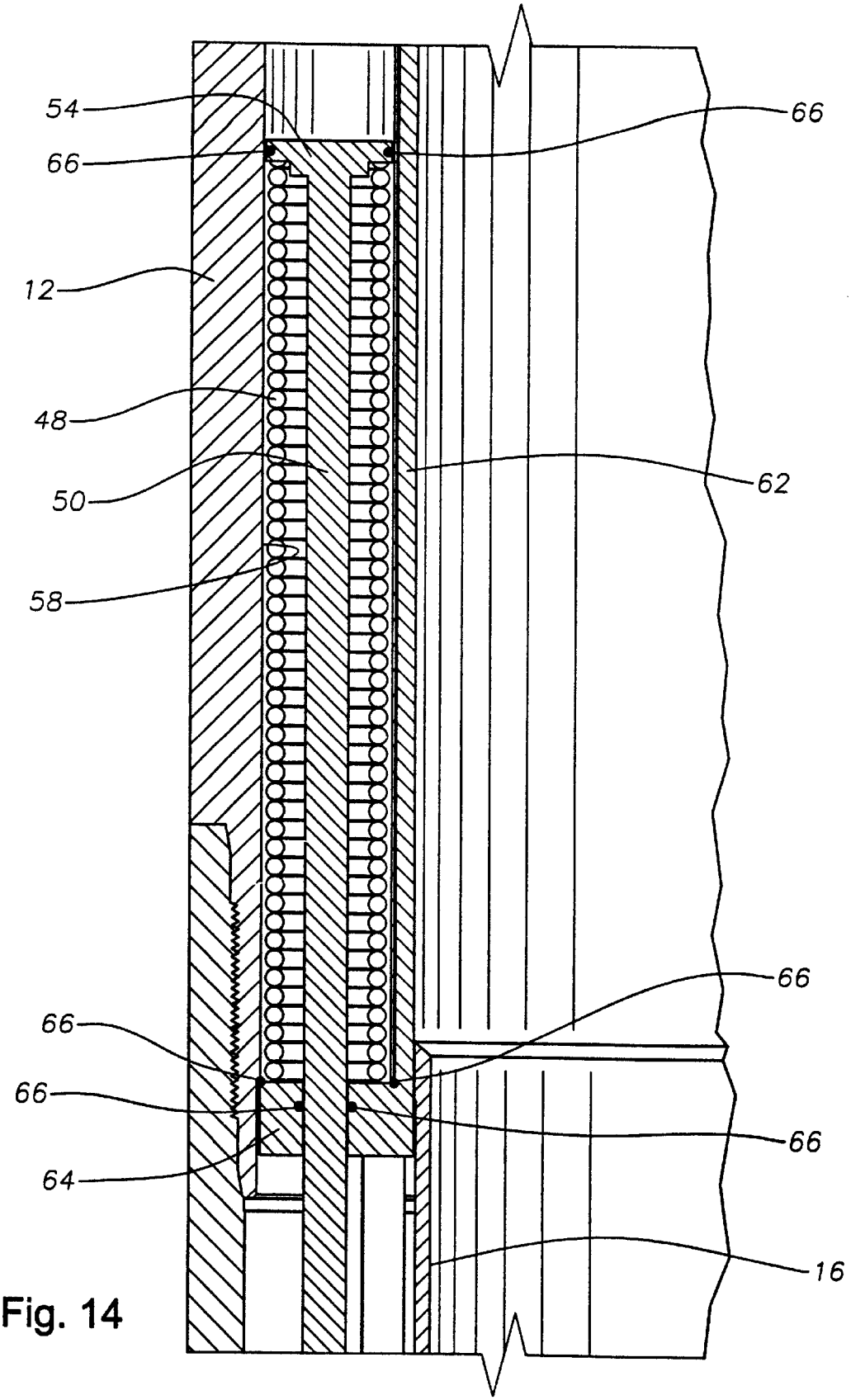
FIG. 14 is a partial longitudinal cross-sectional view of the valve of the present invention illustrating the use of pressurized gas to retract a flow tube in the valve.

In addition to, or instead of, using the return spring(s) 48 and the spring rod(s) 50 to retract the flow tube 16 upon removal of hydraulic fluid from the piston 18, the valve 10 may utilize the force of a pressurized gas to retract the flow tube 16. For example, as shown in FIG. 14, the spring bore 58 may act as a gas chamber by the inclusion of appropriate seals 66. The gas chamber may be filled with a volume of pressurized gas, such as nitrogen.

Figure 4A:
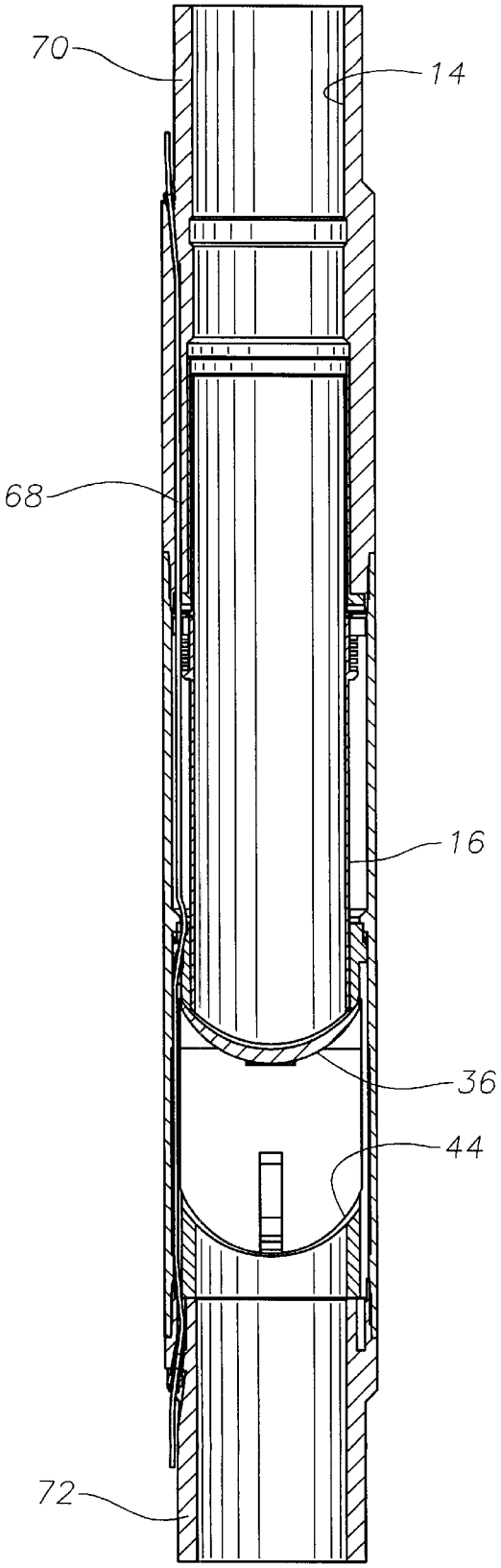
FIG. 4A is a longitudinal cross-sectional view taken along line 4—4 of FIG. 2, and illustrates the valve in the closed position.
Figure 4B:
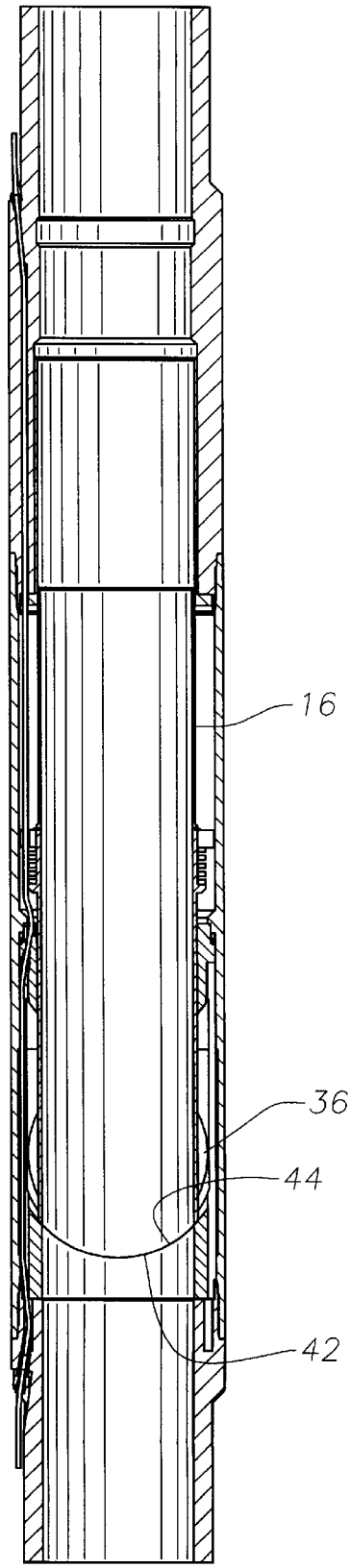
FIG. 4B is a longitudinal cross-sectional view taken along line 4—4 of FIG. 2, and illustrates the valve in the open position.
Figure 5B:
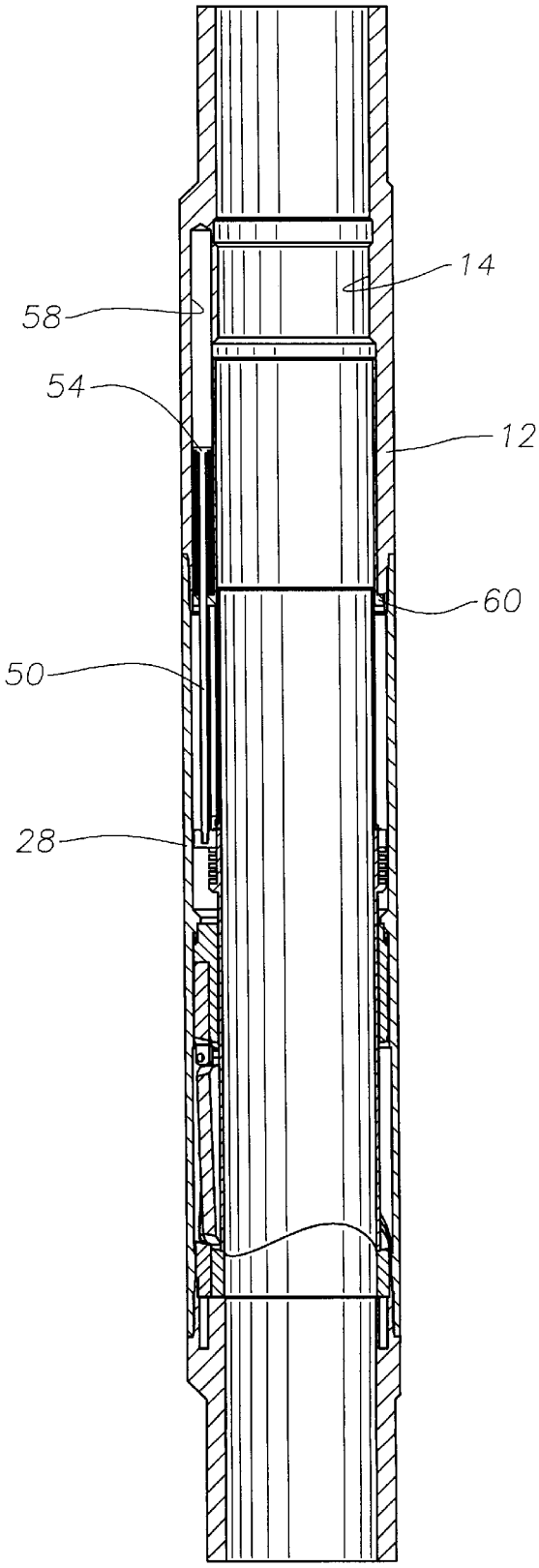
FIG. 5B is a longitudinal cross-sectional view taken along line 5—5 of FIG. 2, and illustrates the valve in the open position.
Figure 6A:
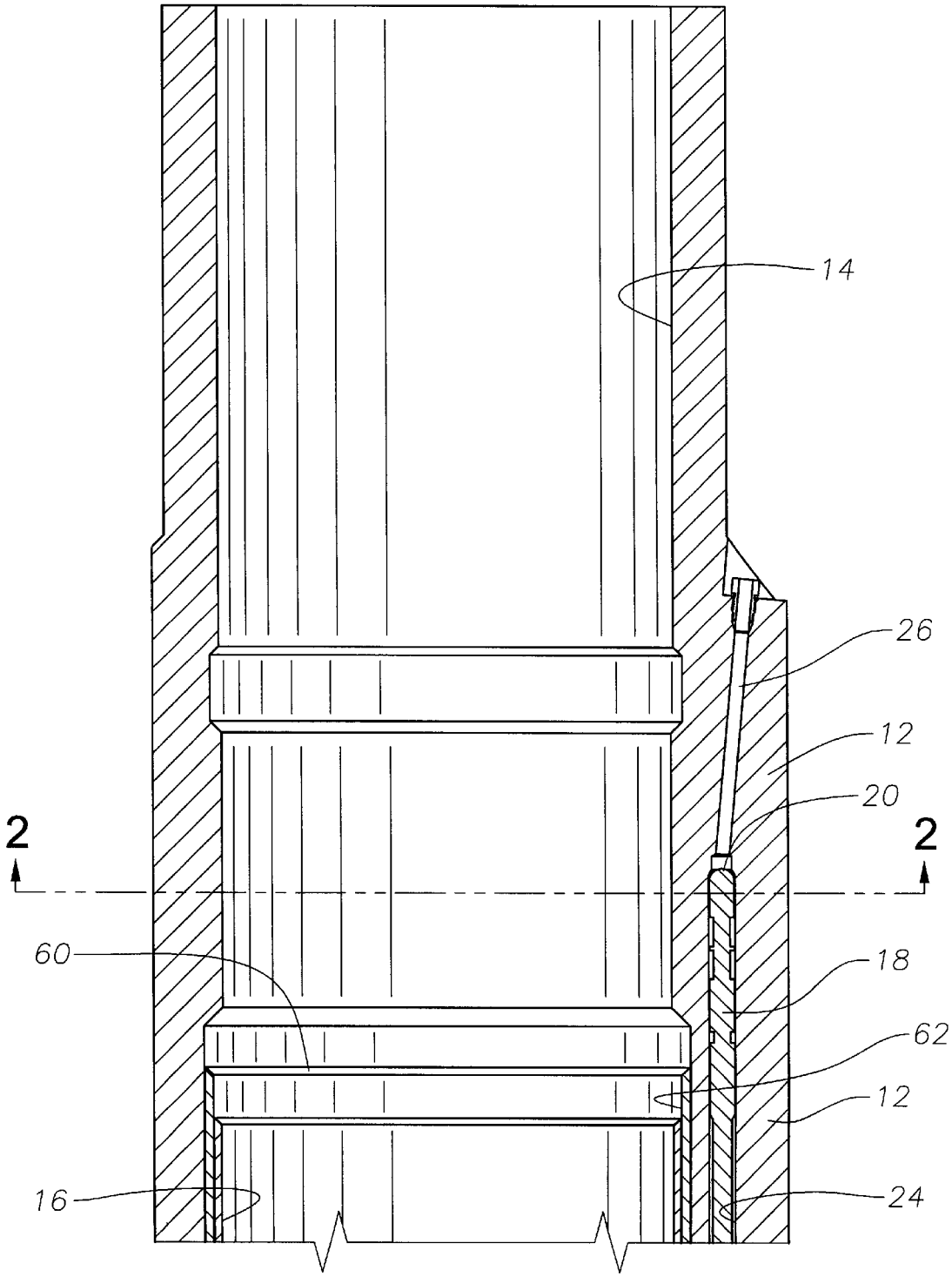
FIGS. 6A–6D, taken together, represent an enlargement of FIG. 1.
Figure 6B:
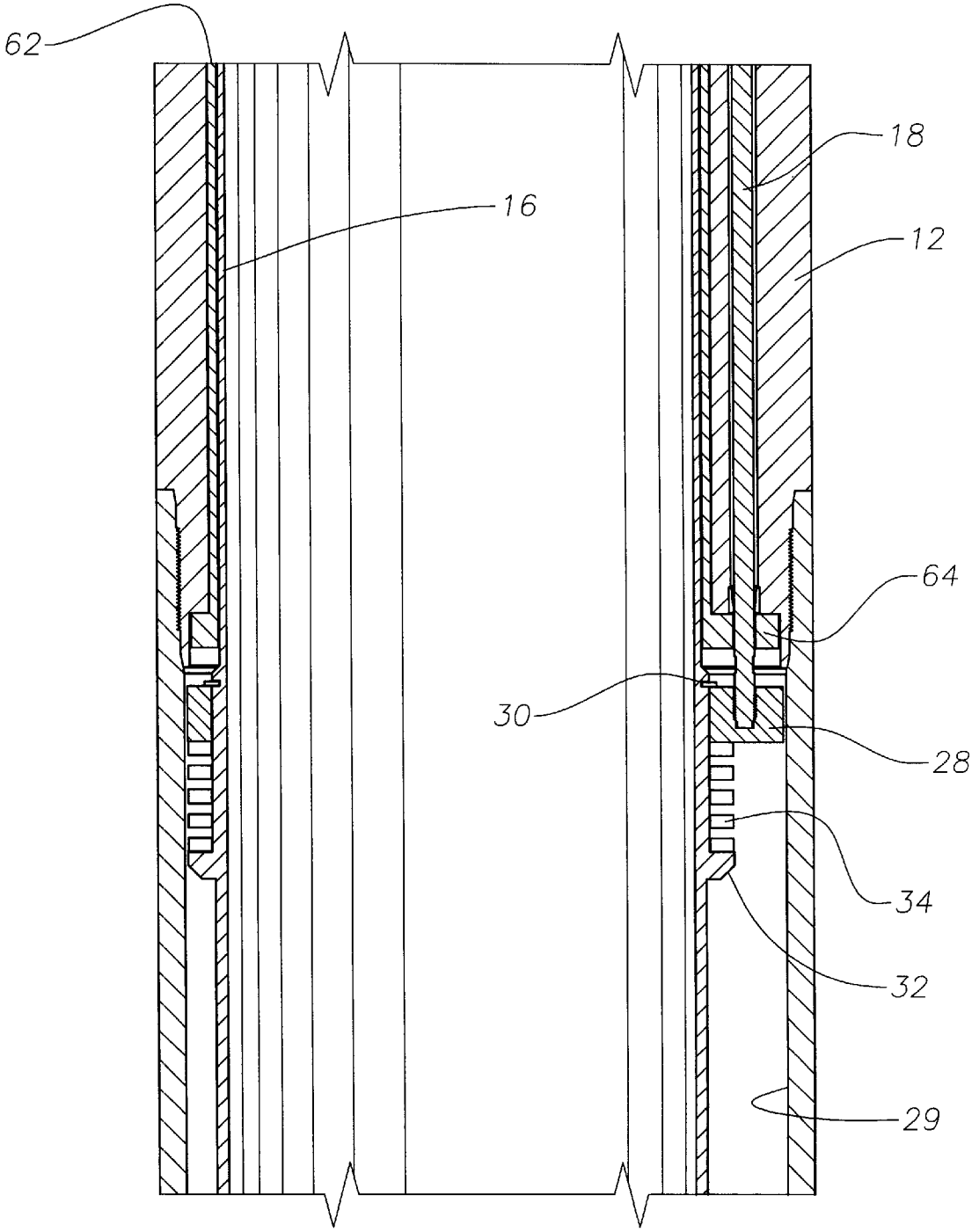
Figure 6C:
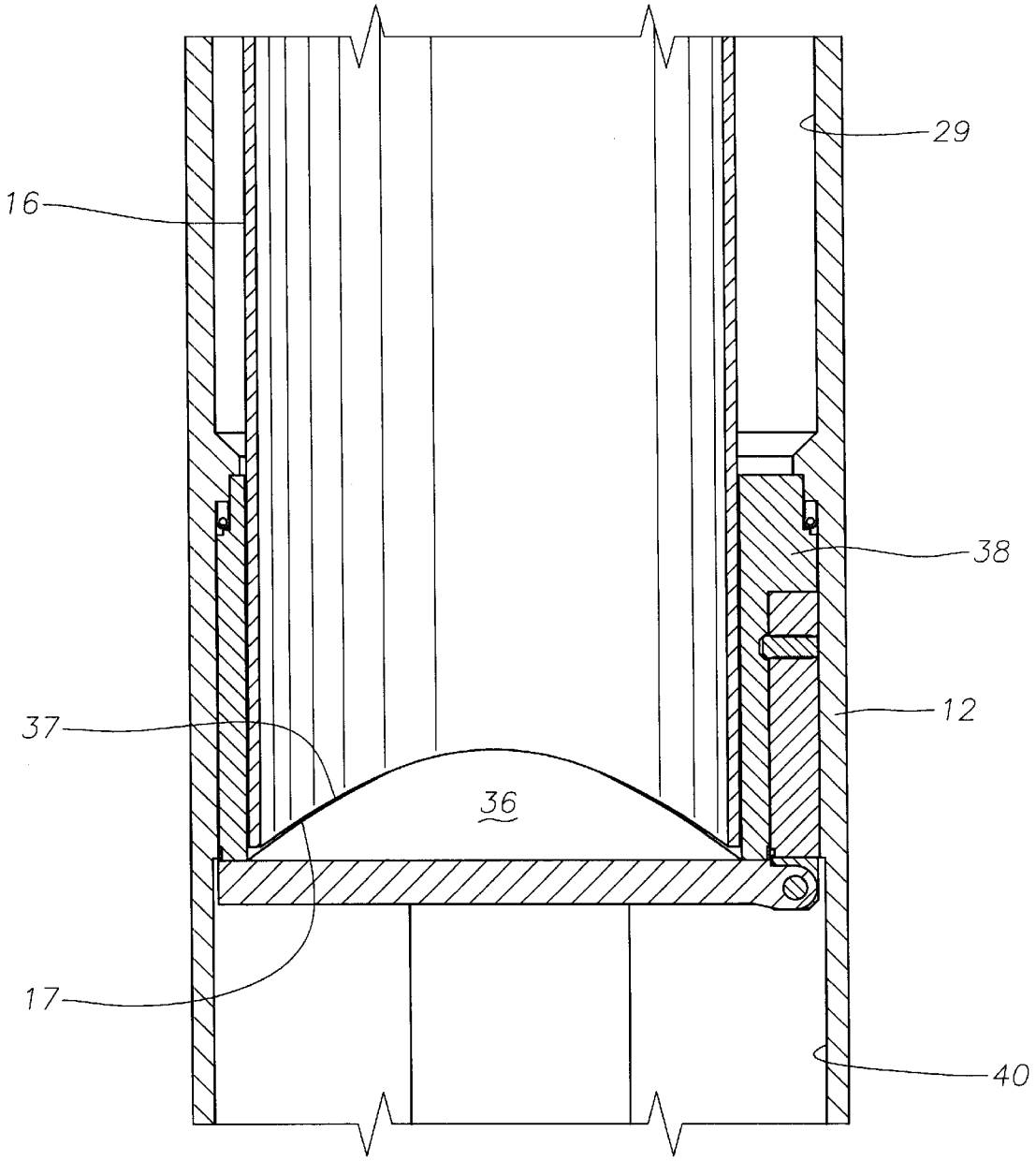
Figure 6D:
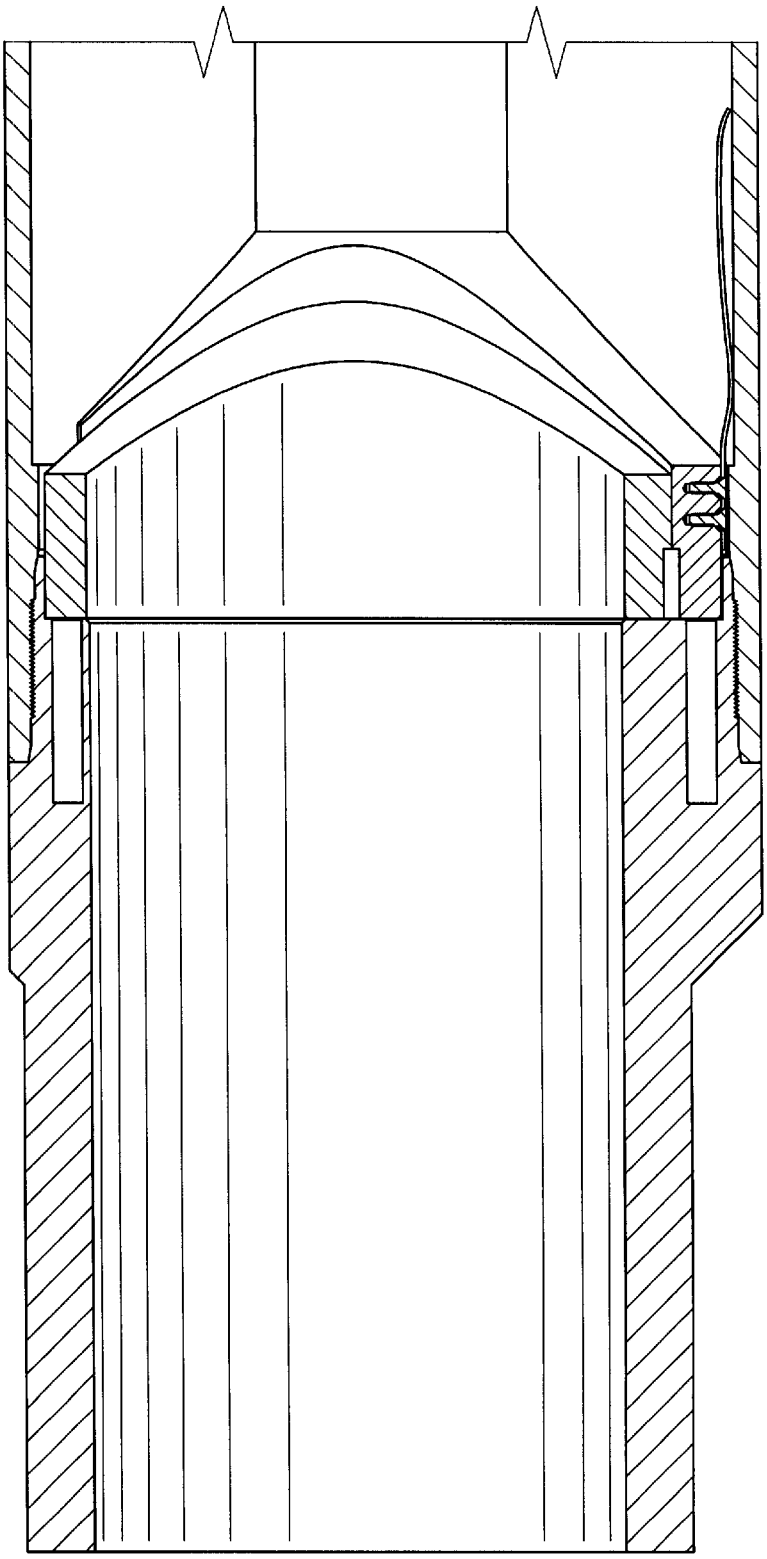
Figure 7:
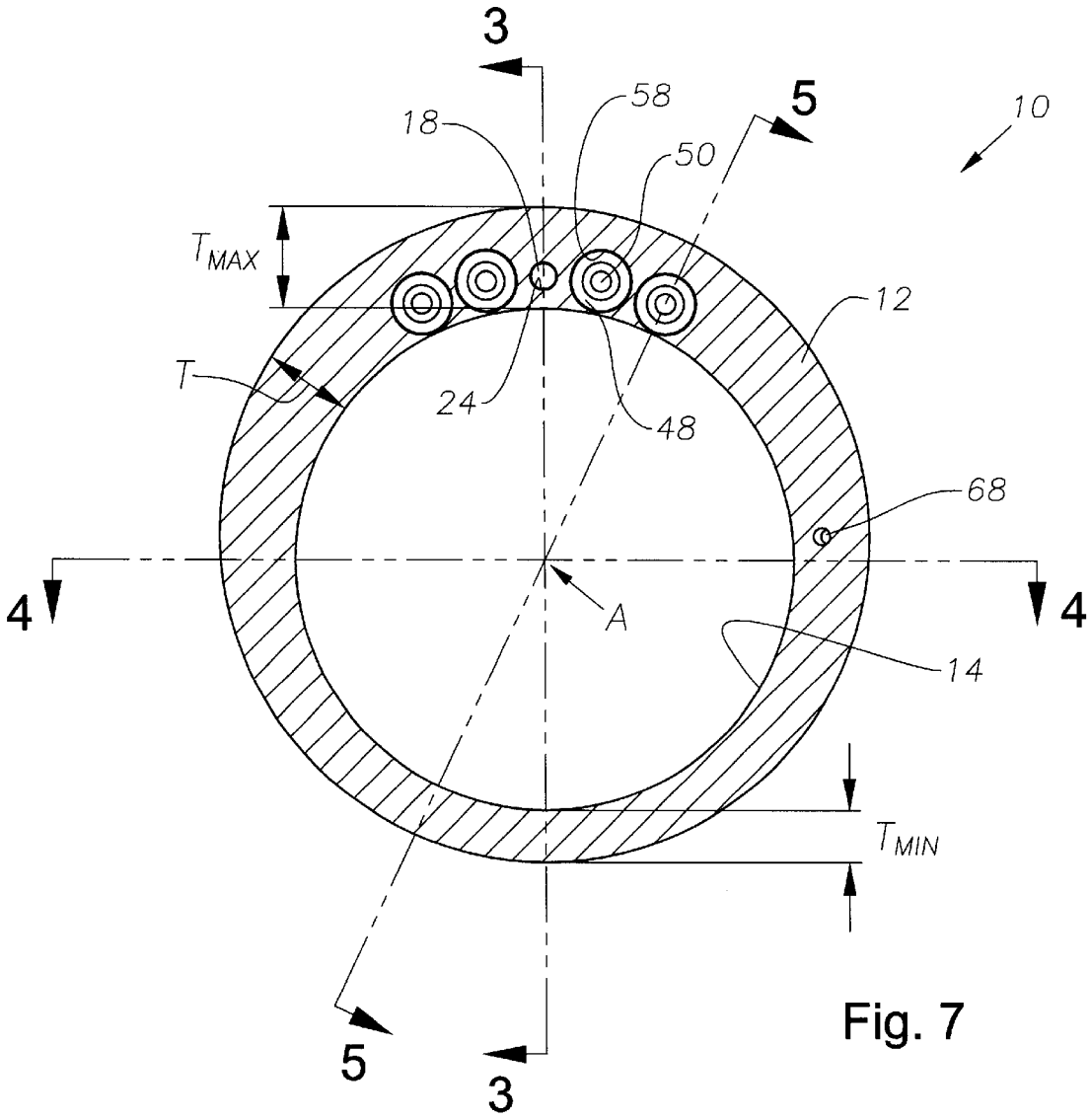
FIGS. 7 represents an enlargement of FIG. 2.
Figure 8A:
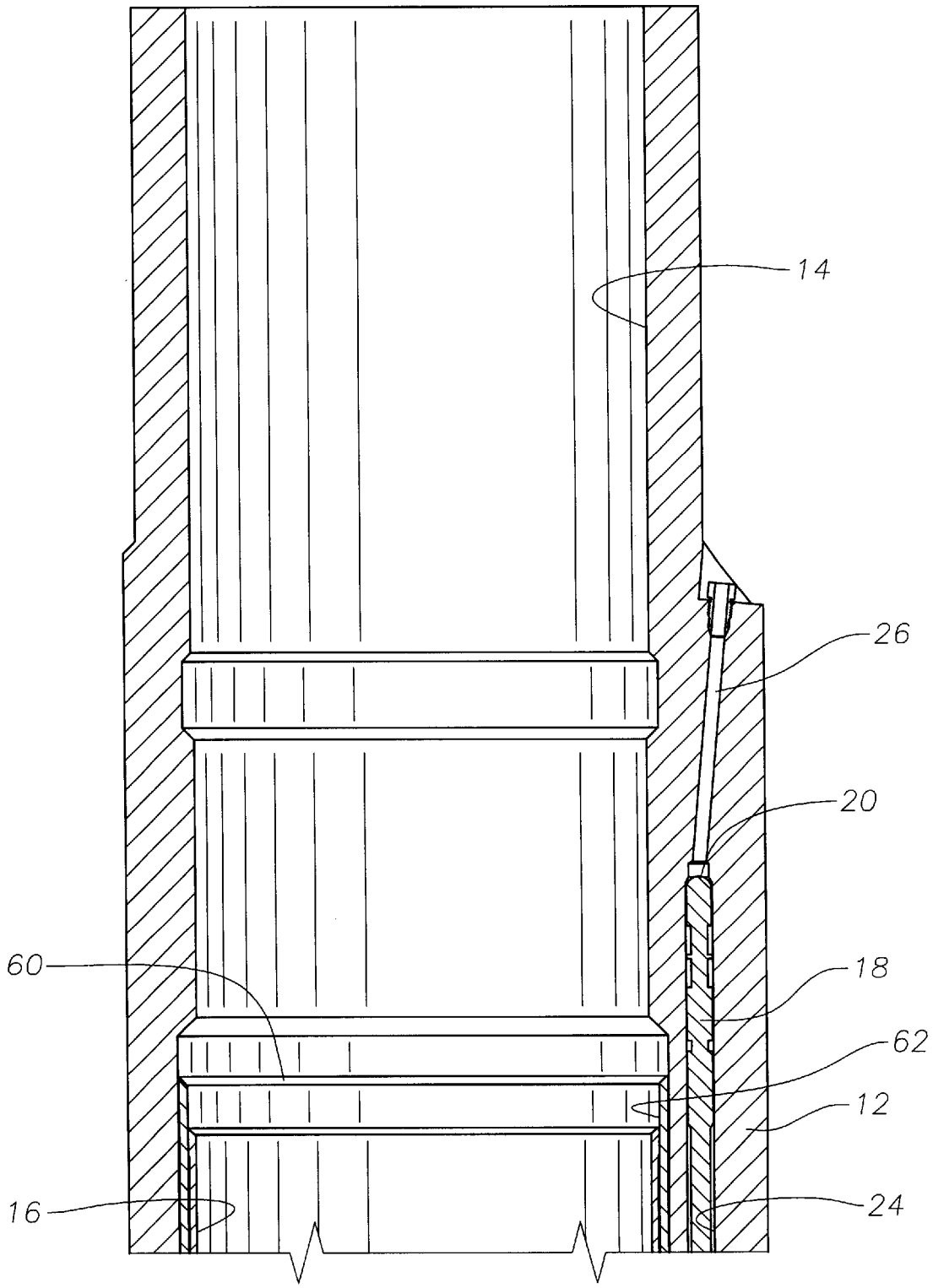
FIGS. 8A–8D, taken together, represent an enlargement of FIG. 3A.
Figure 8B:
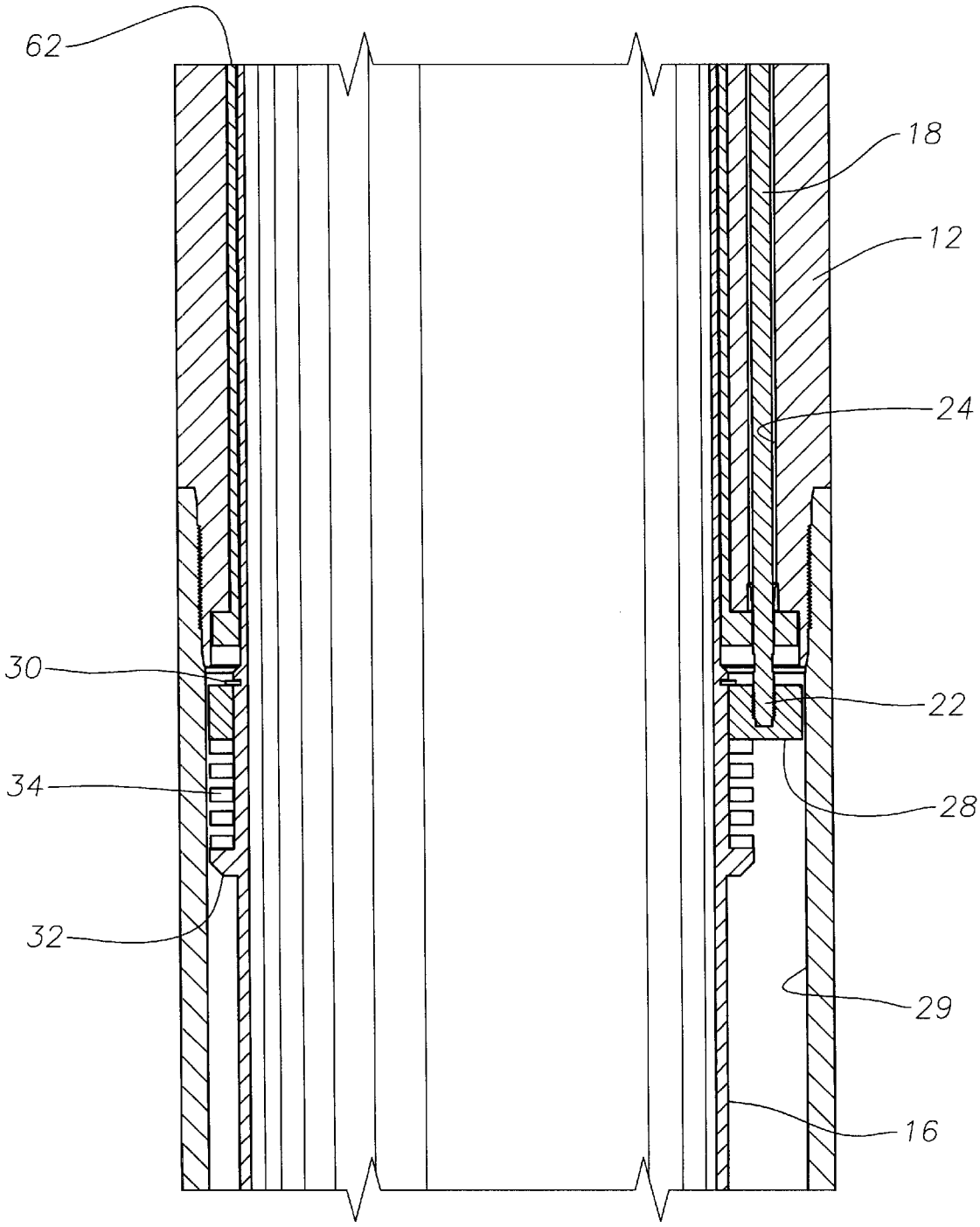
Figure 8C:
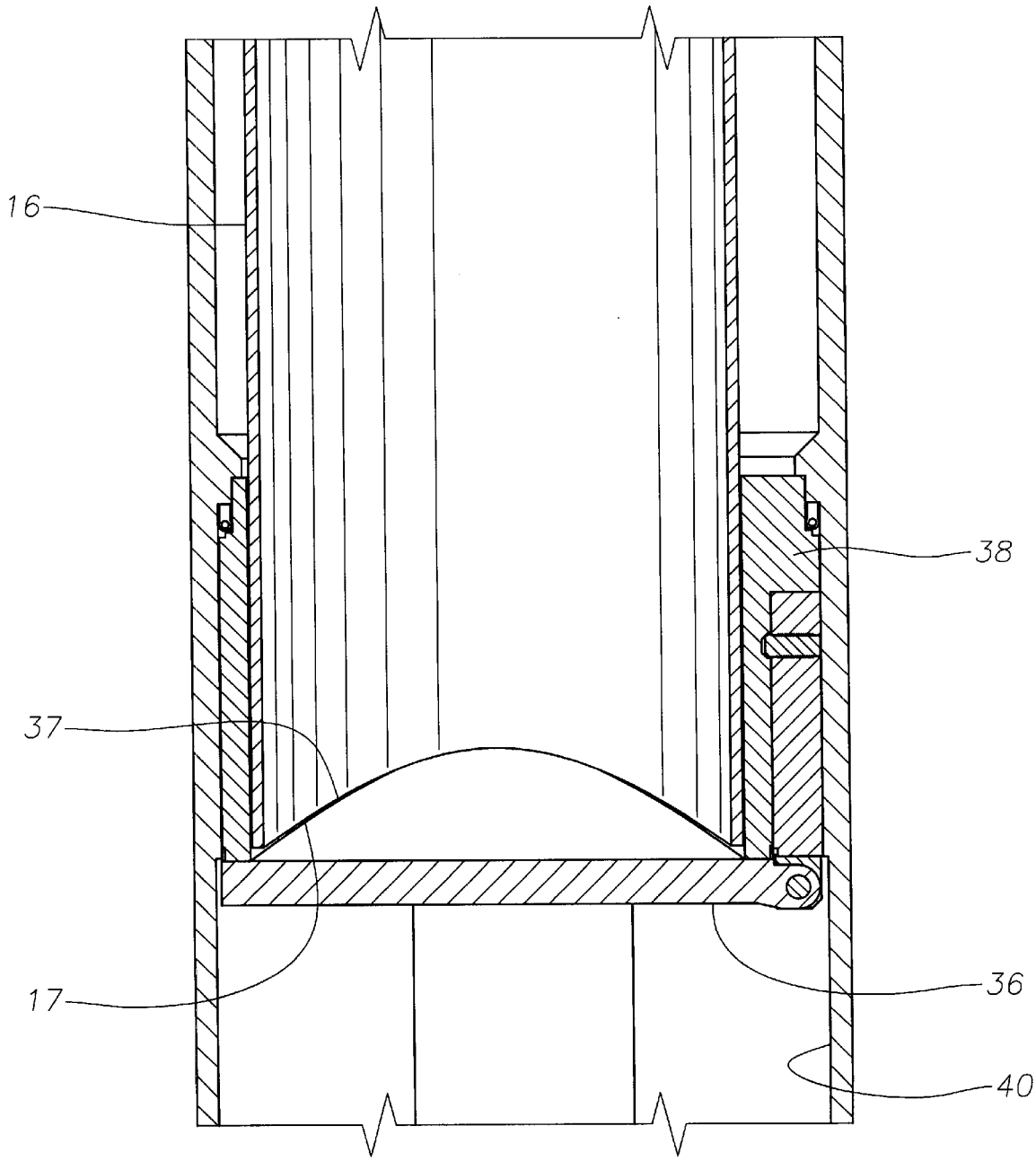
Figure 8D:
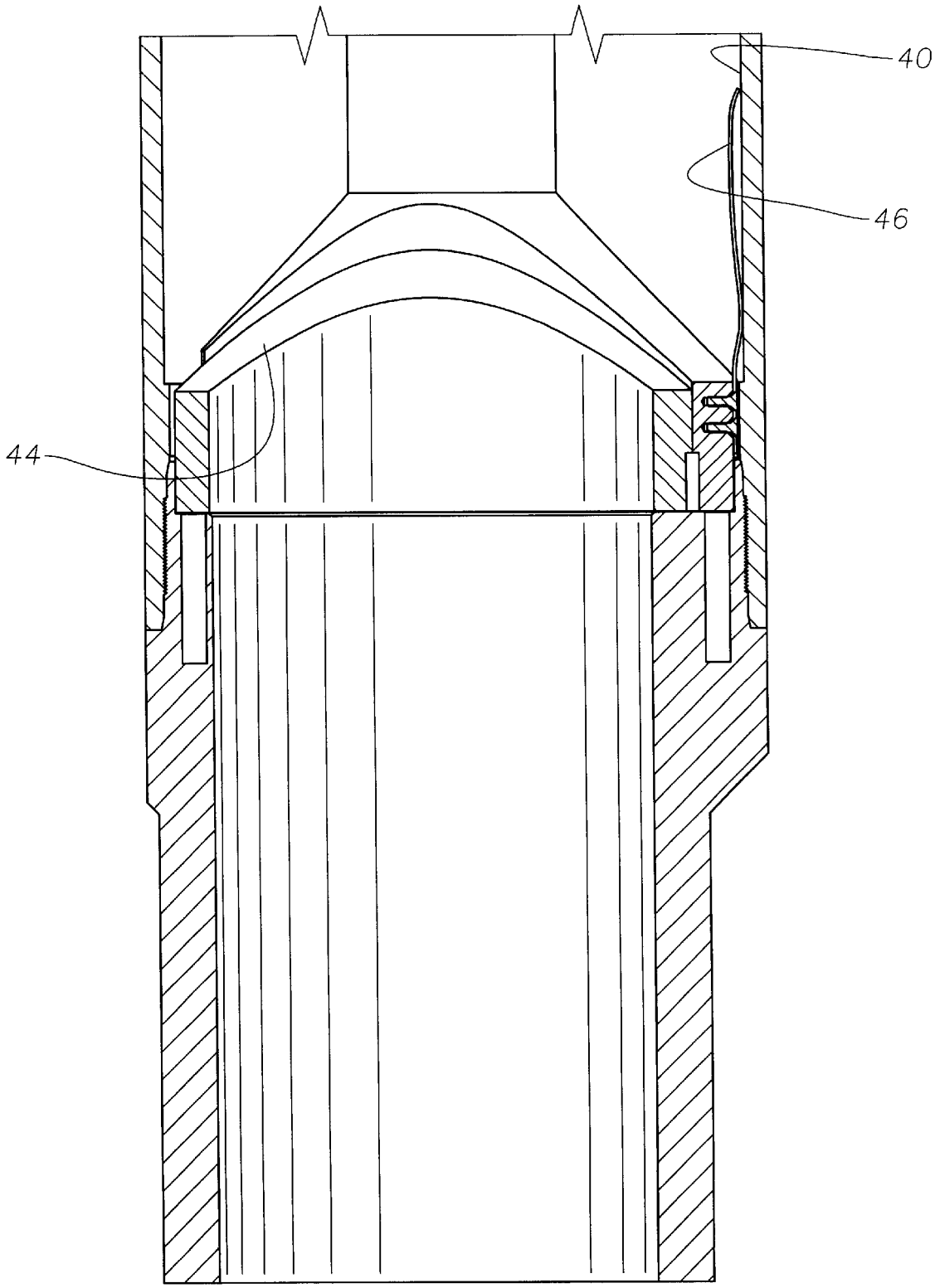
Figure 9A:
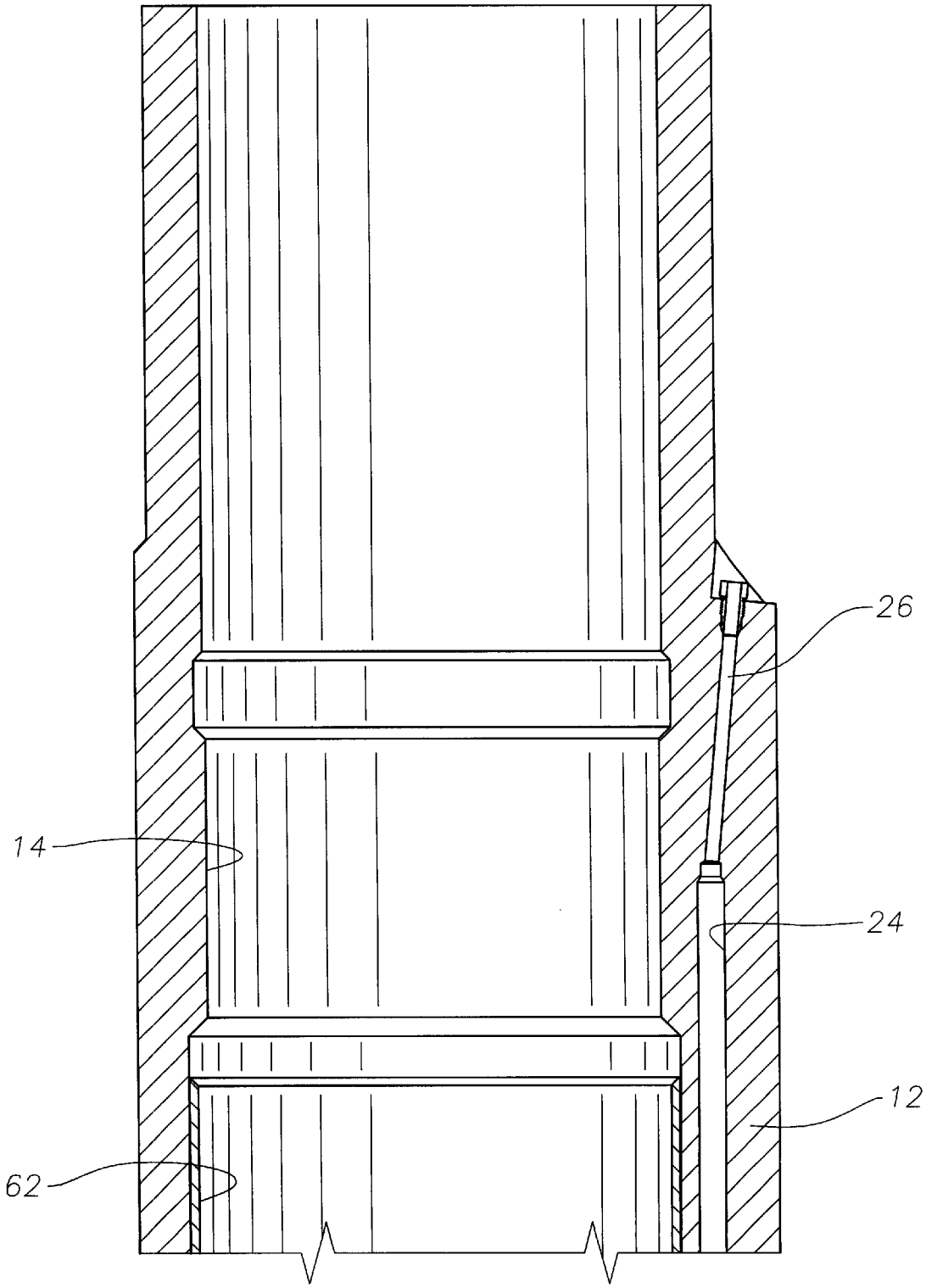
FIGS. 9A–9D, taken together, represent an enlargement of FIG. 3B.
Figure 9B:
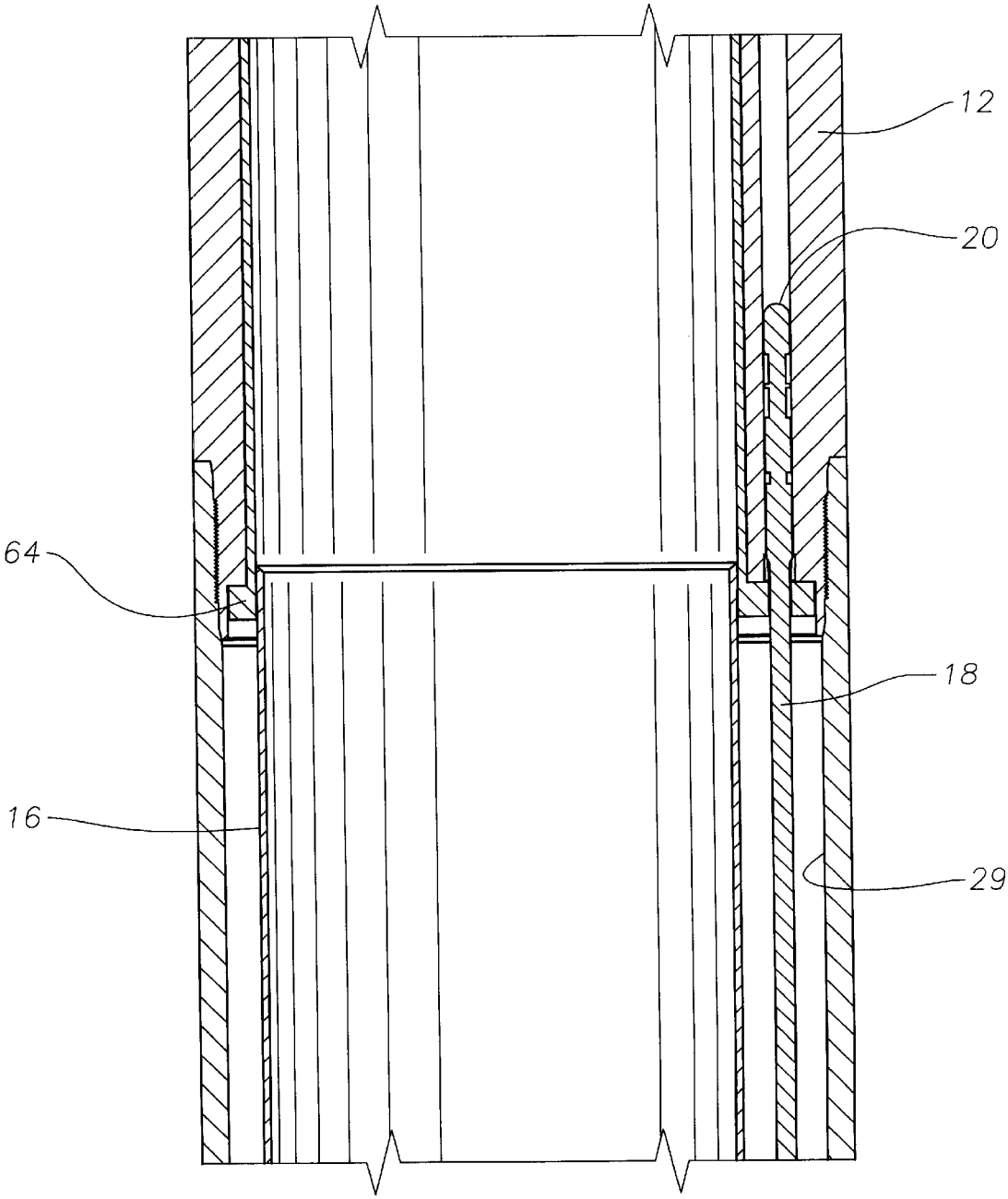
Figure 9C:
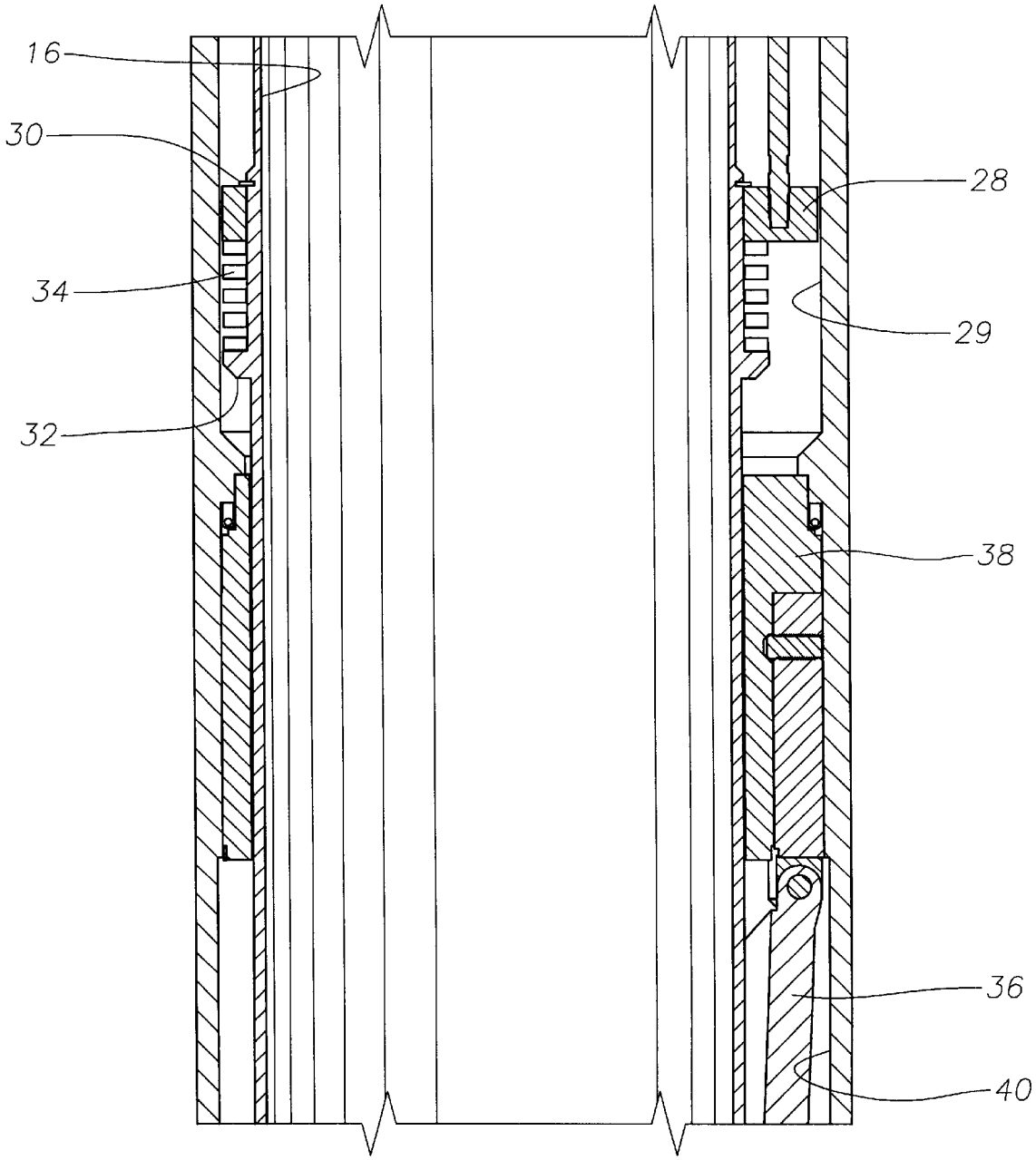
Figure 9D:
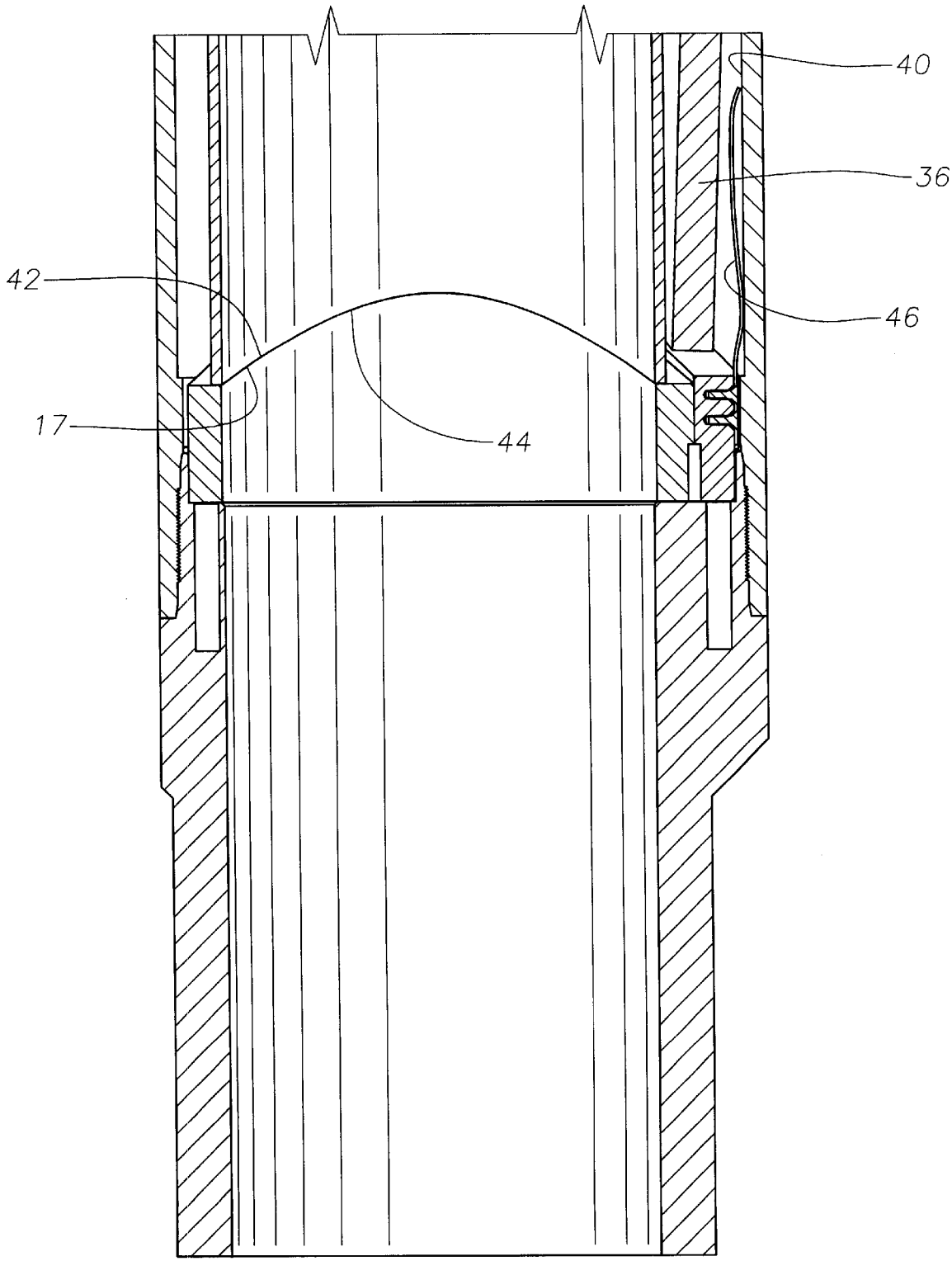
Figure 10B:
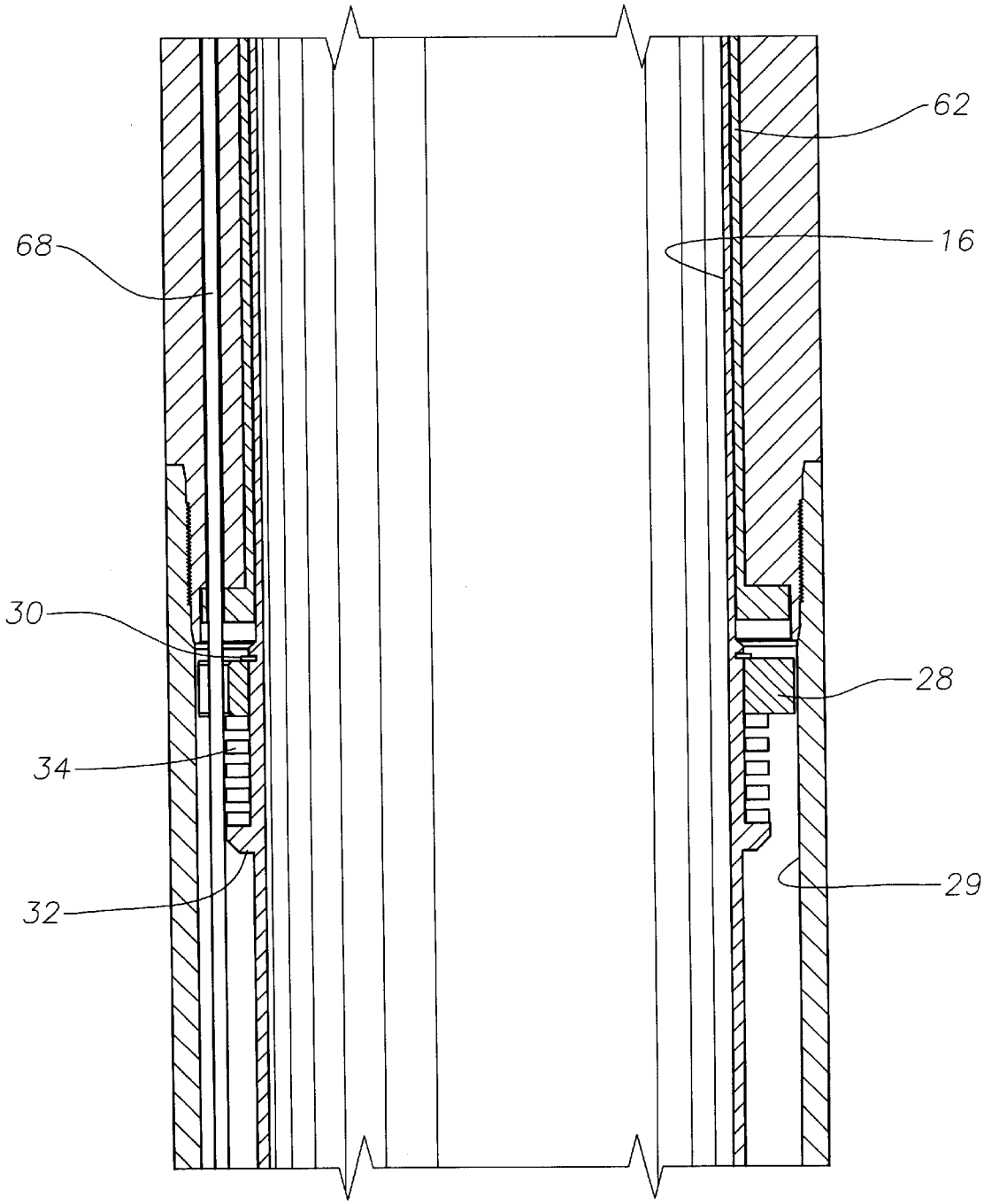
FIGS. 10A–10D, taken together, represent an enlargement of FIG. 4A.
Figure 10A:
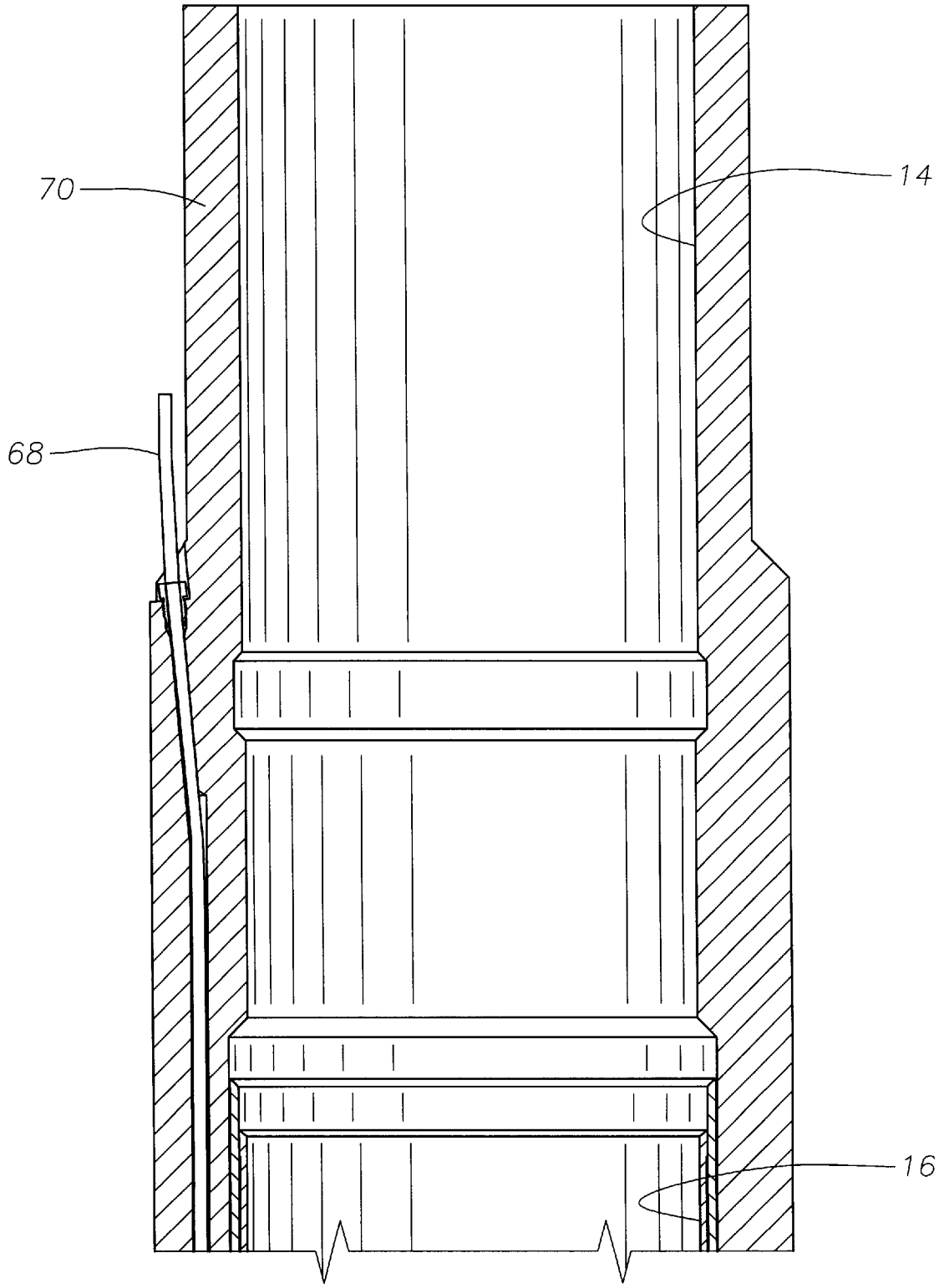
Figure 10C:
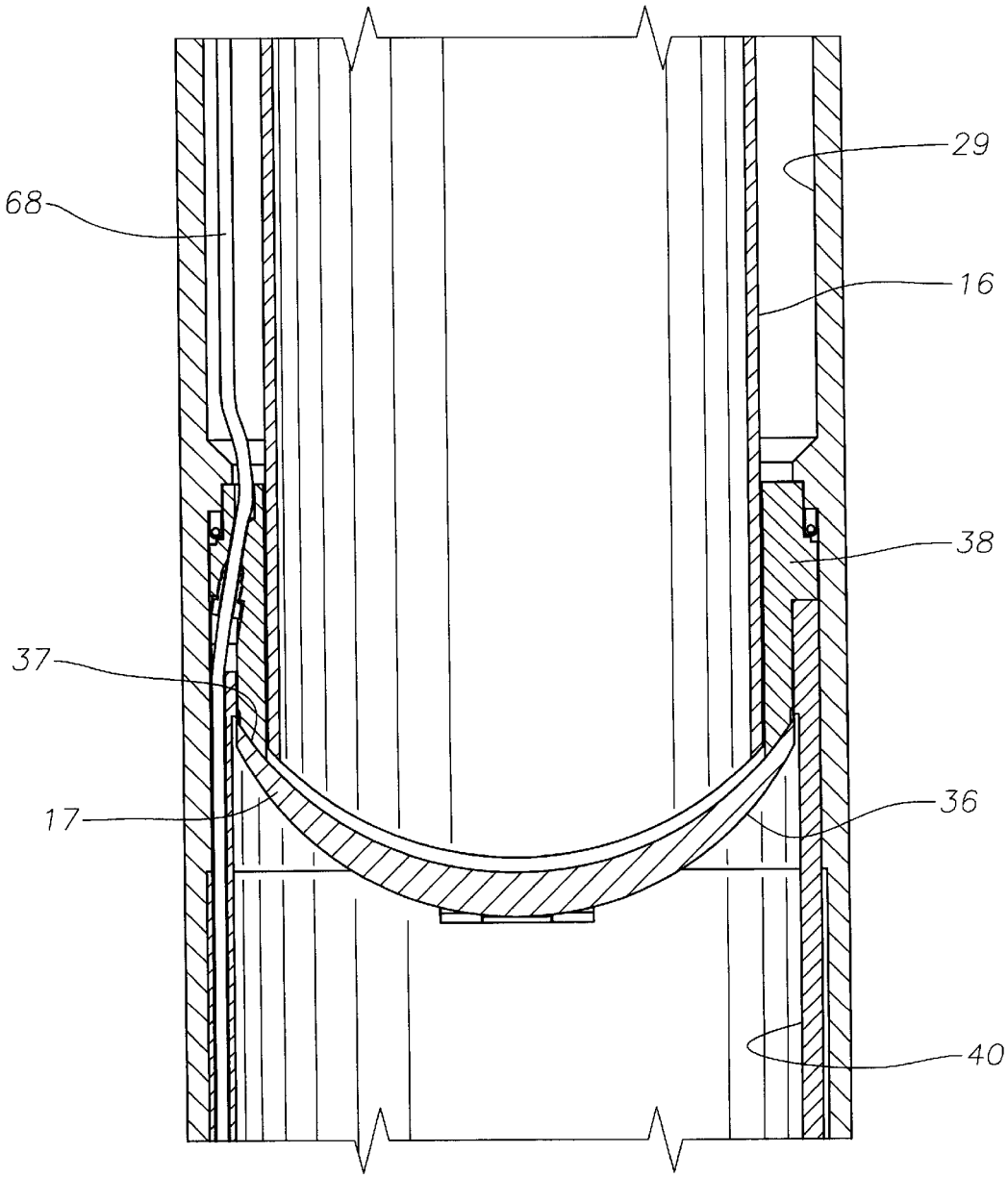
Figure 10D:
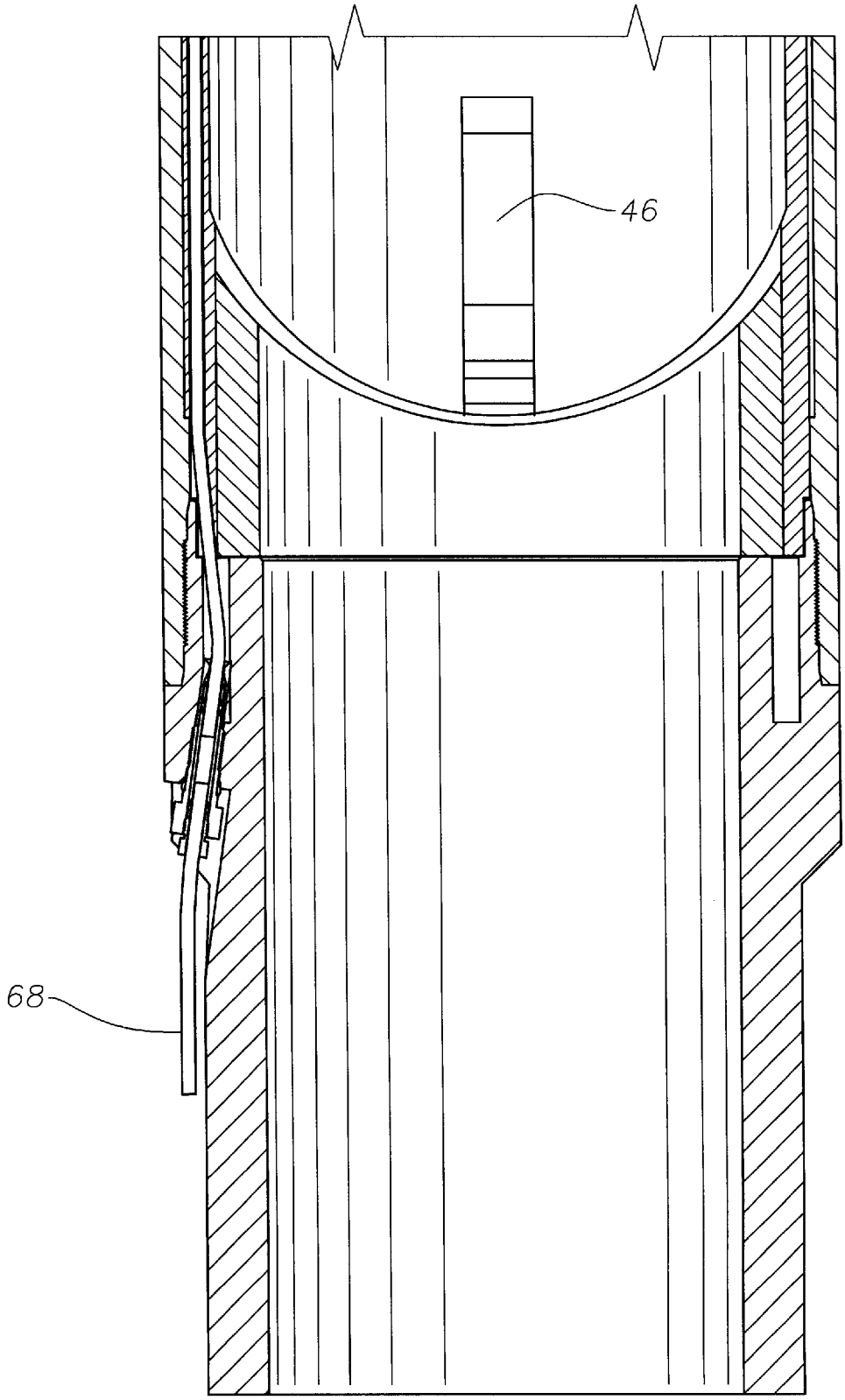
Figure 11A:
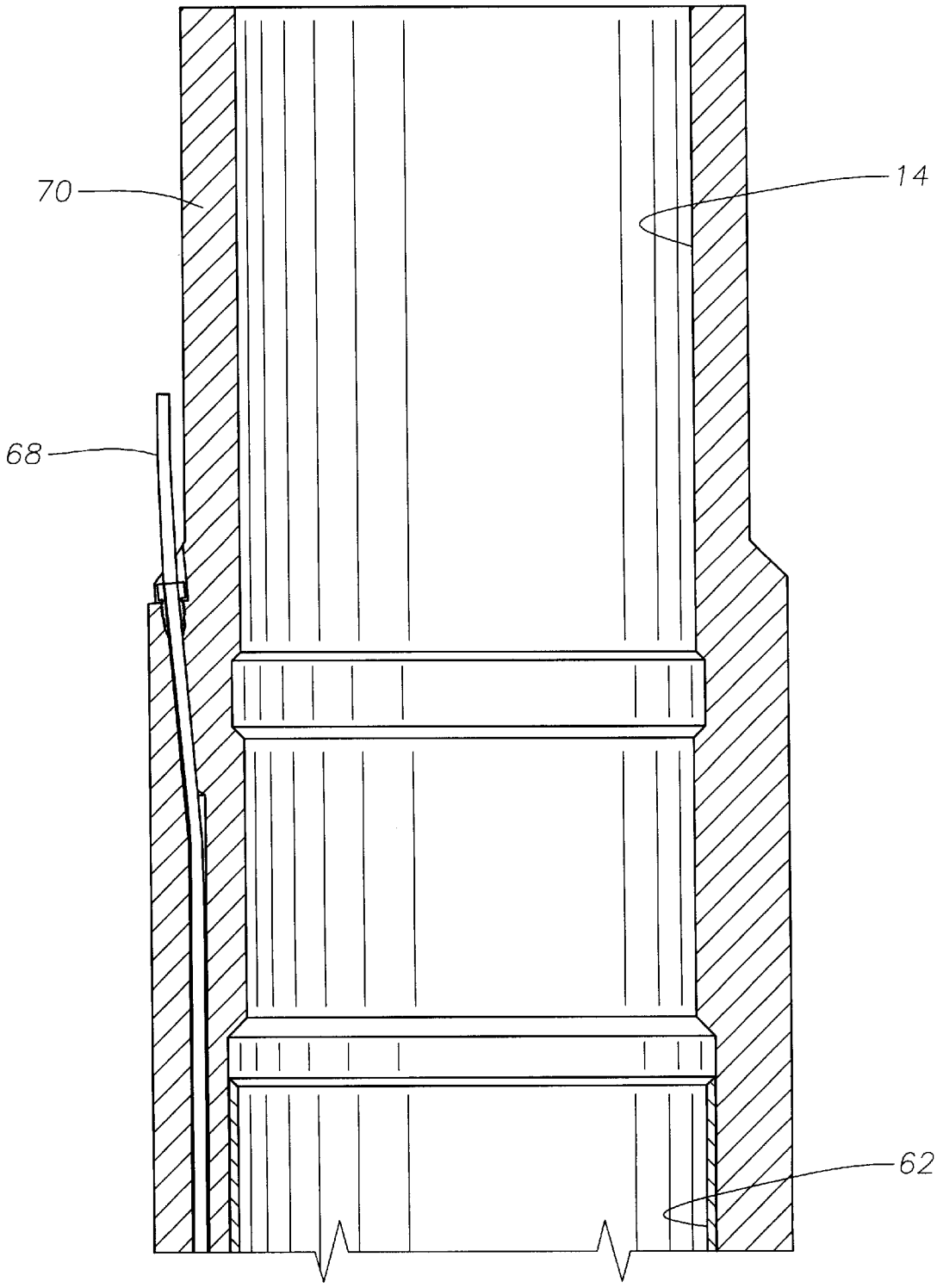
FIGS. 11A–11D, taken together, represent an enlargement of FIG. 4B.
Figure 11B:
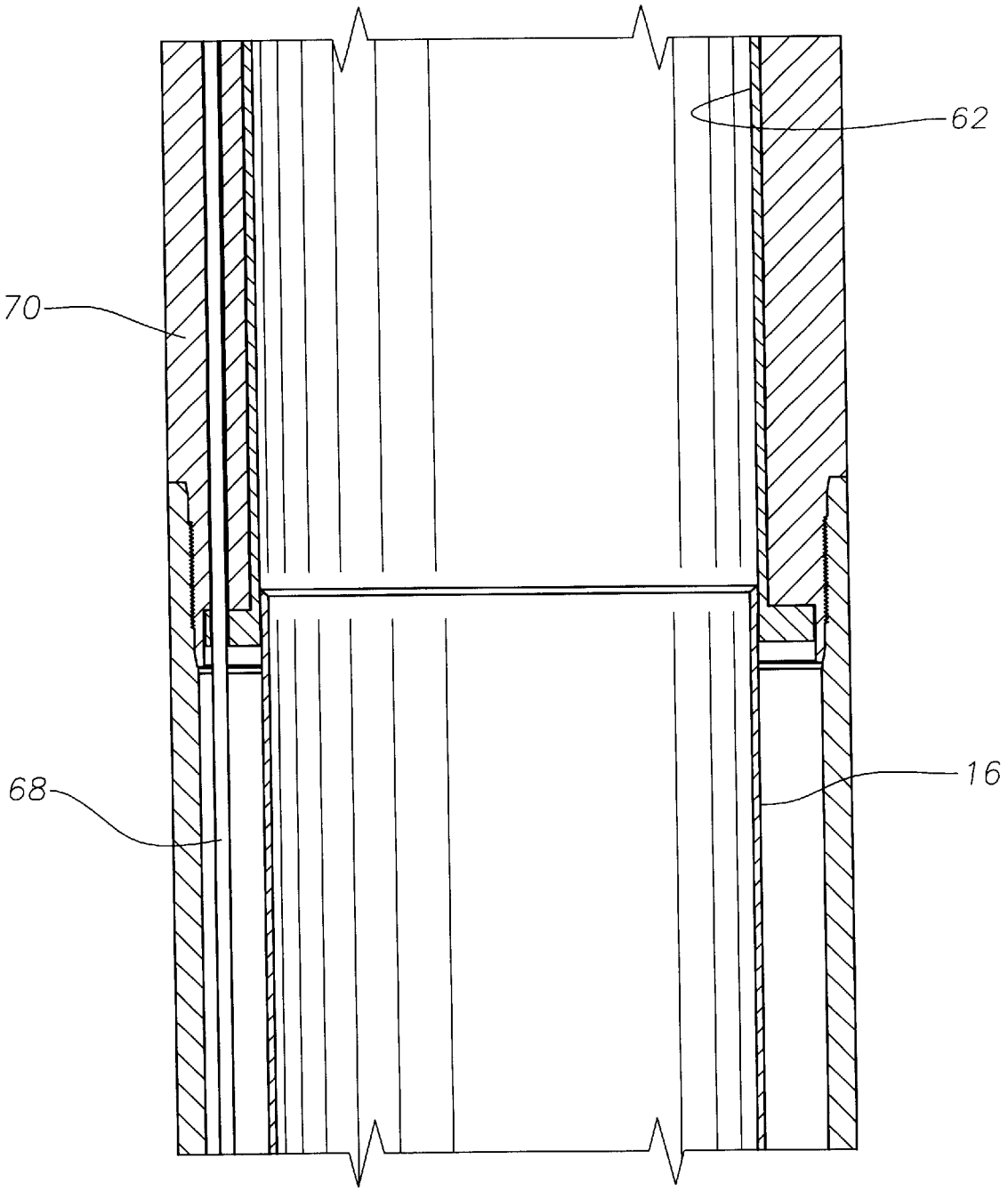
Figure 11C:
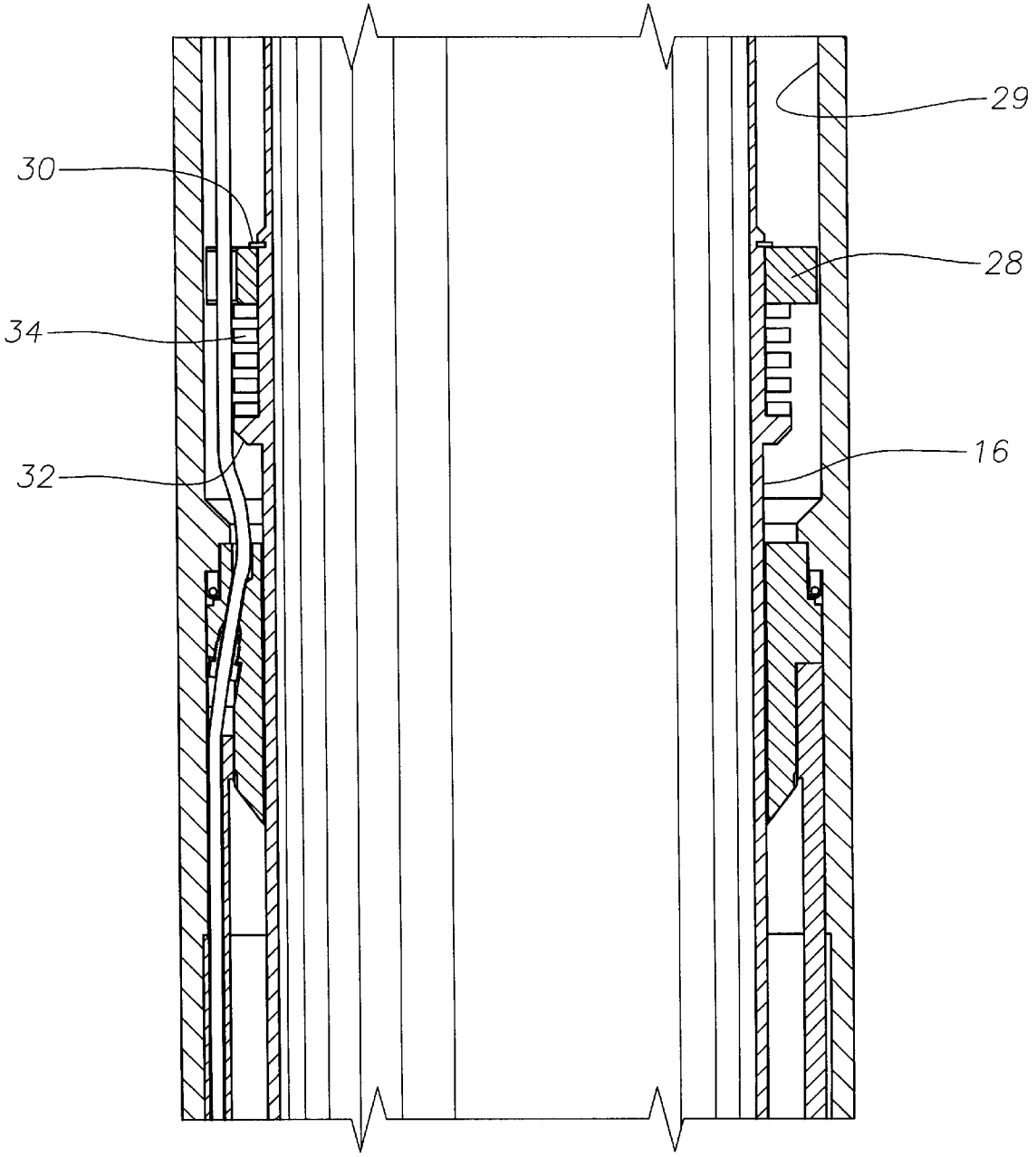
Figure 11D:
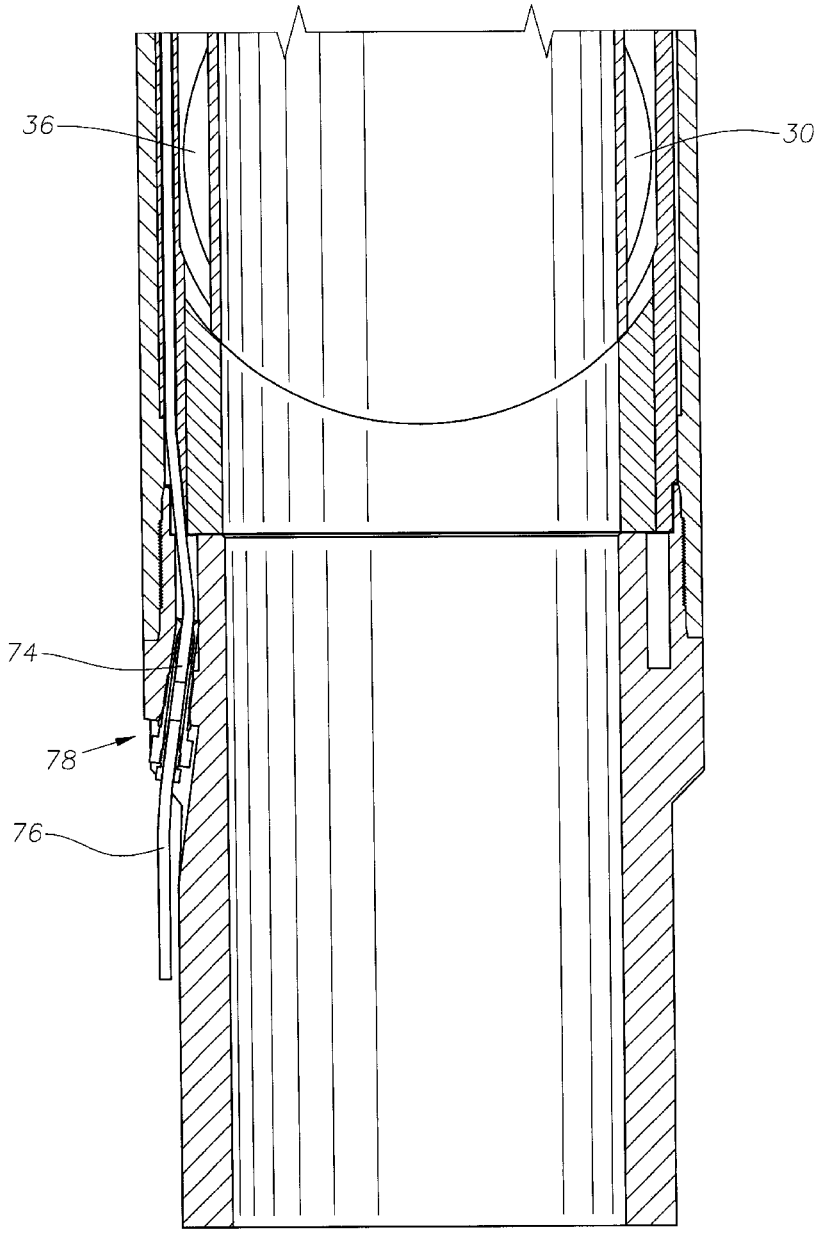
Figure 12A:
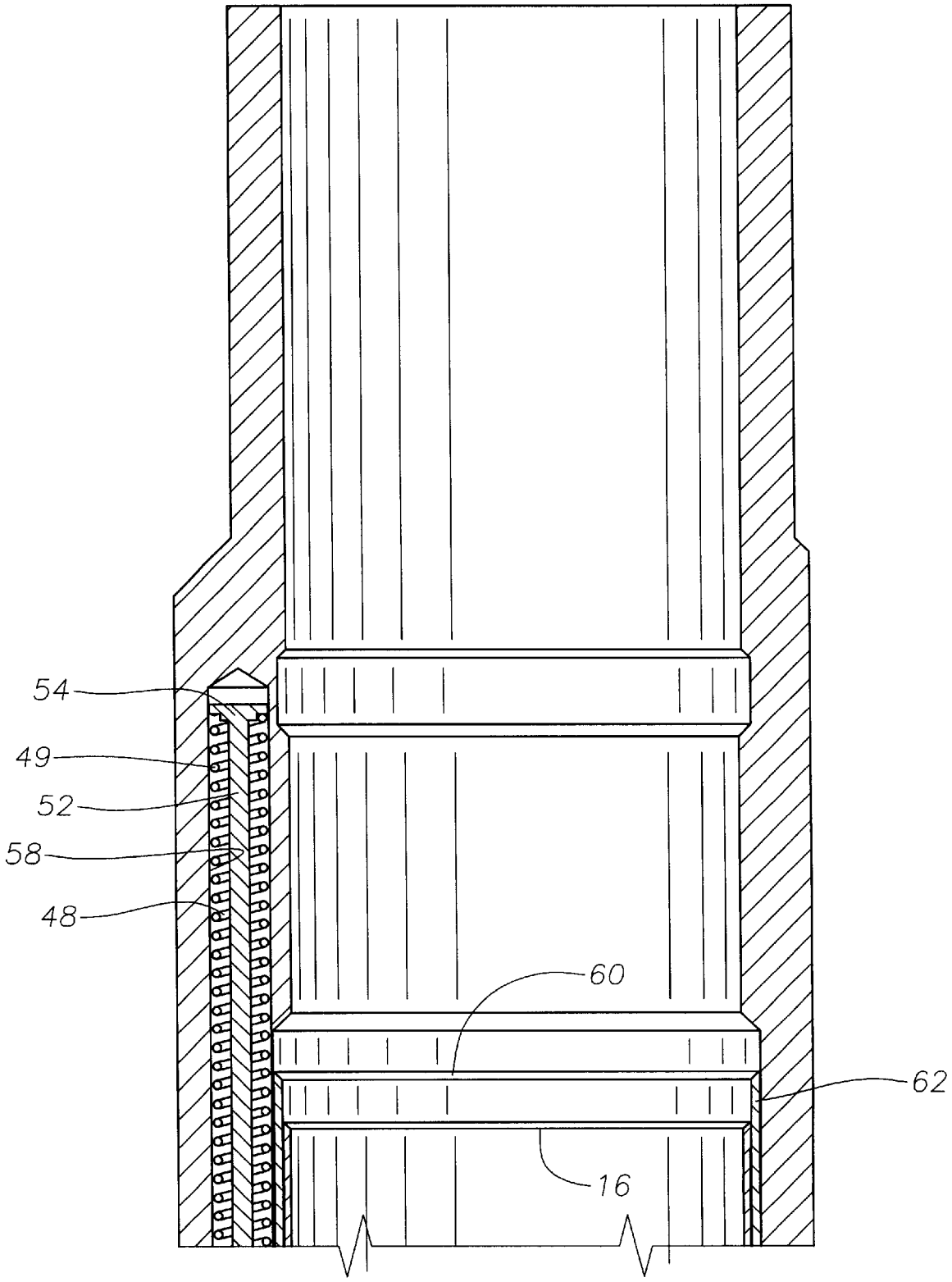
FIGS. 12A–12D, taken together, represent an enlargement of FIG. 5A.
Figure 12B:
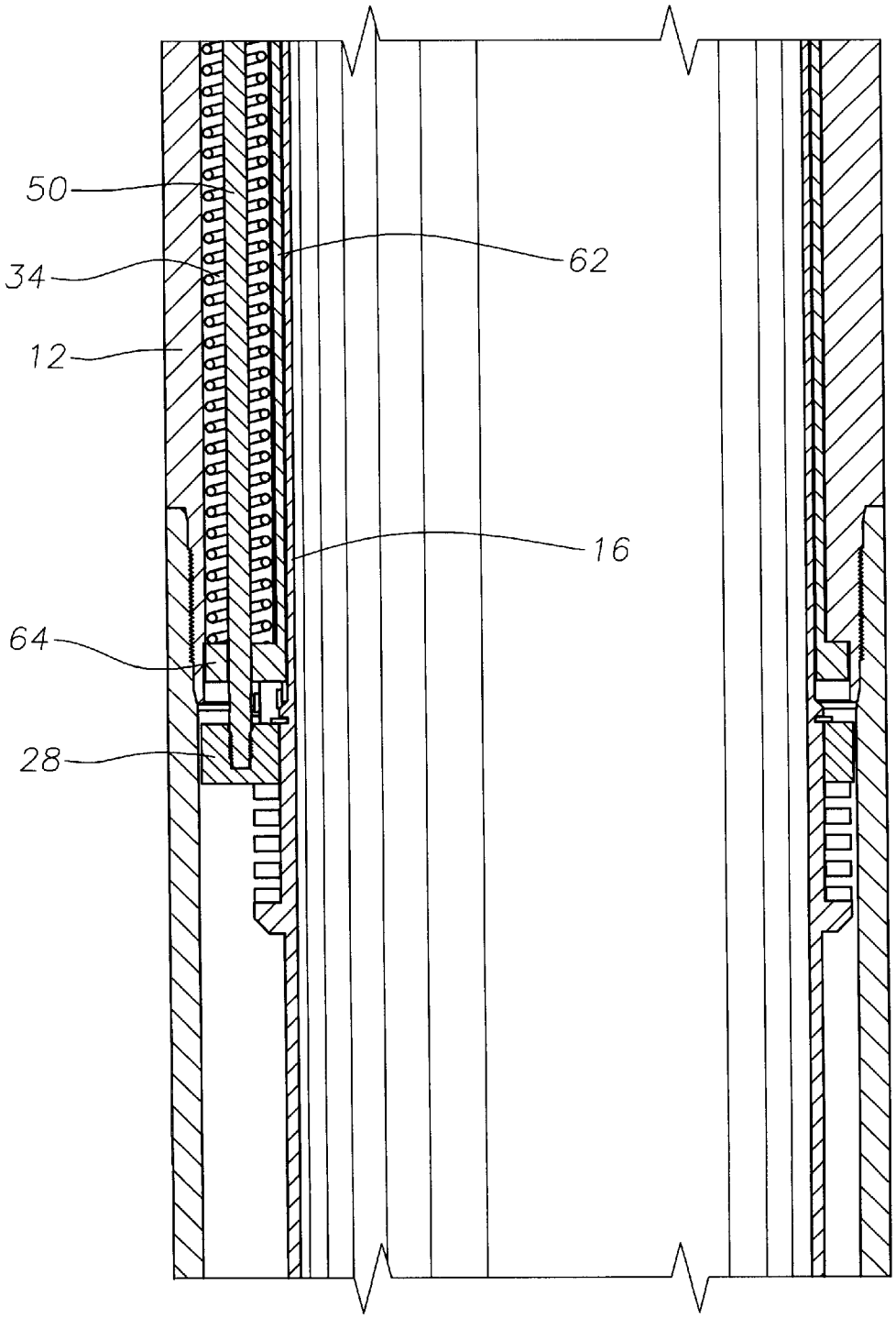
Figure 12C:
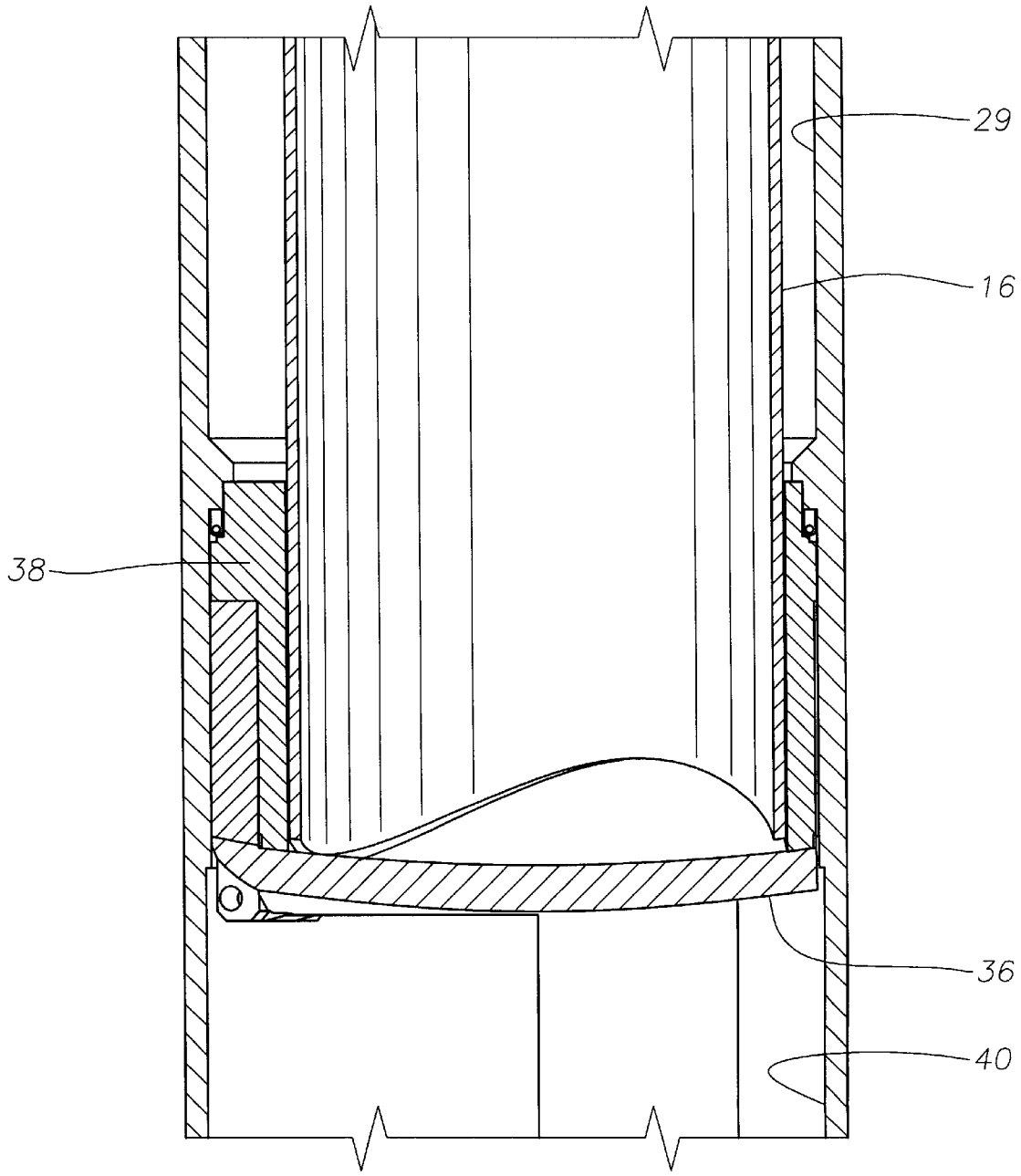
Figure 12D:
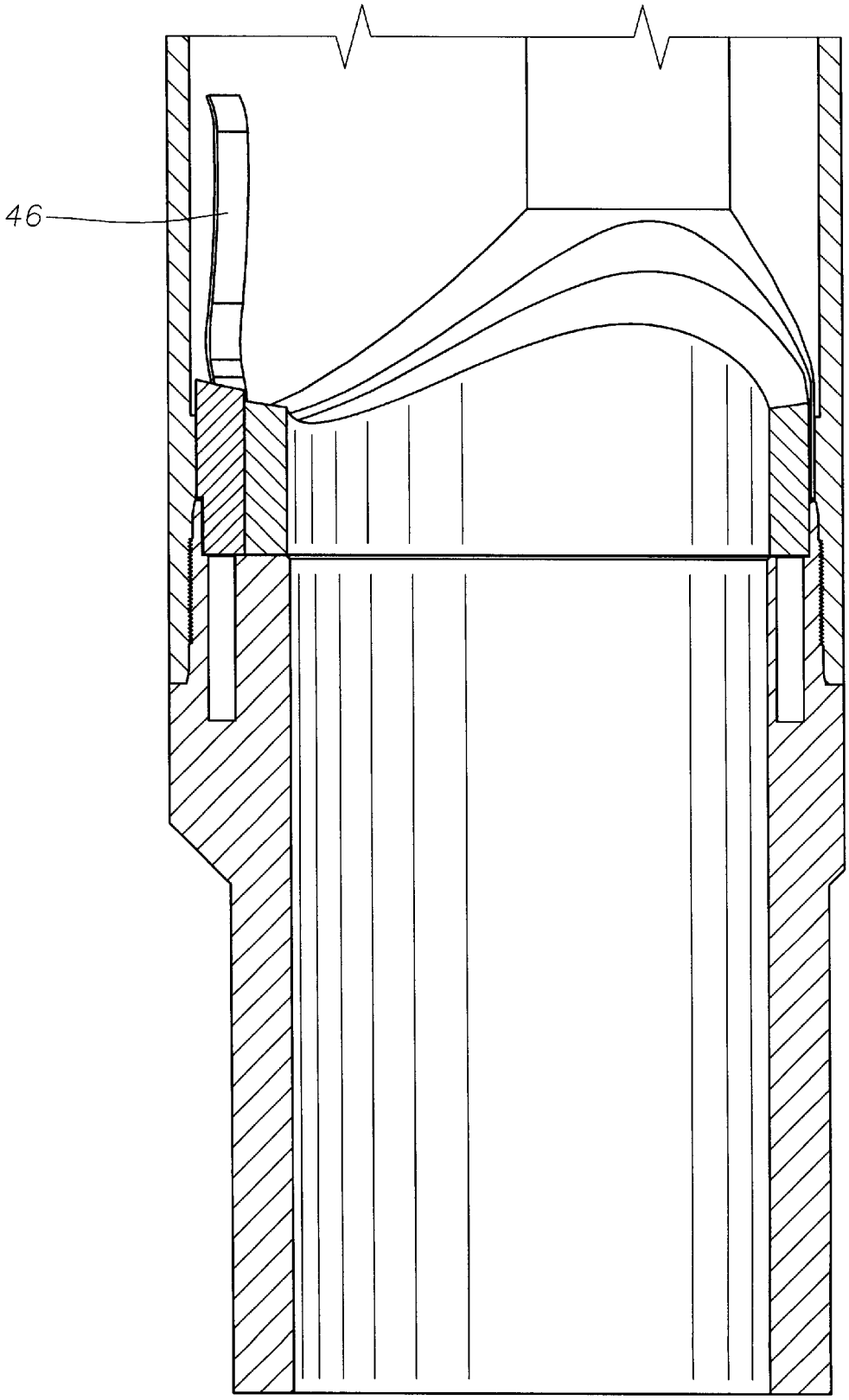
Figure 13A:
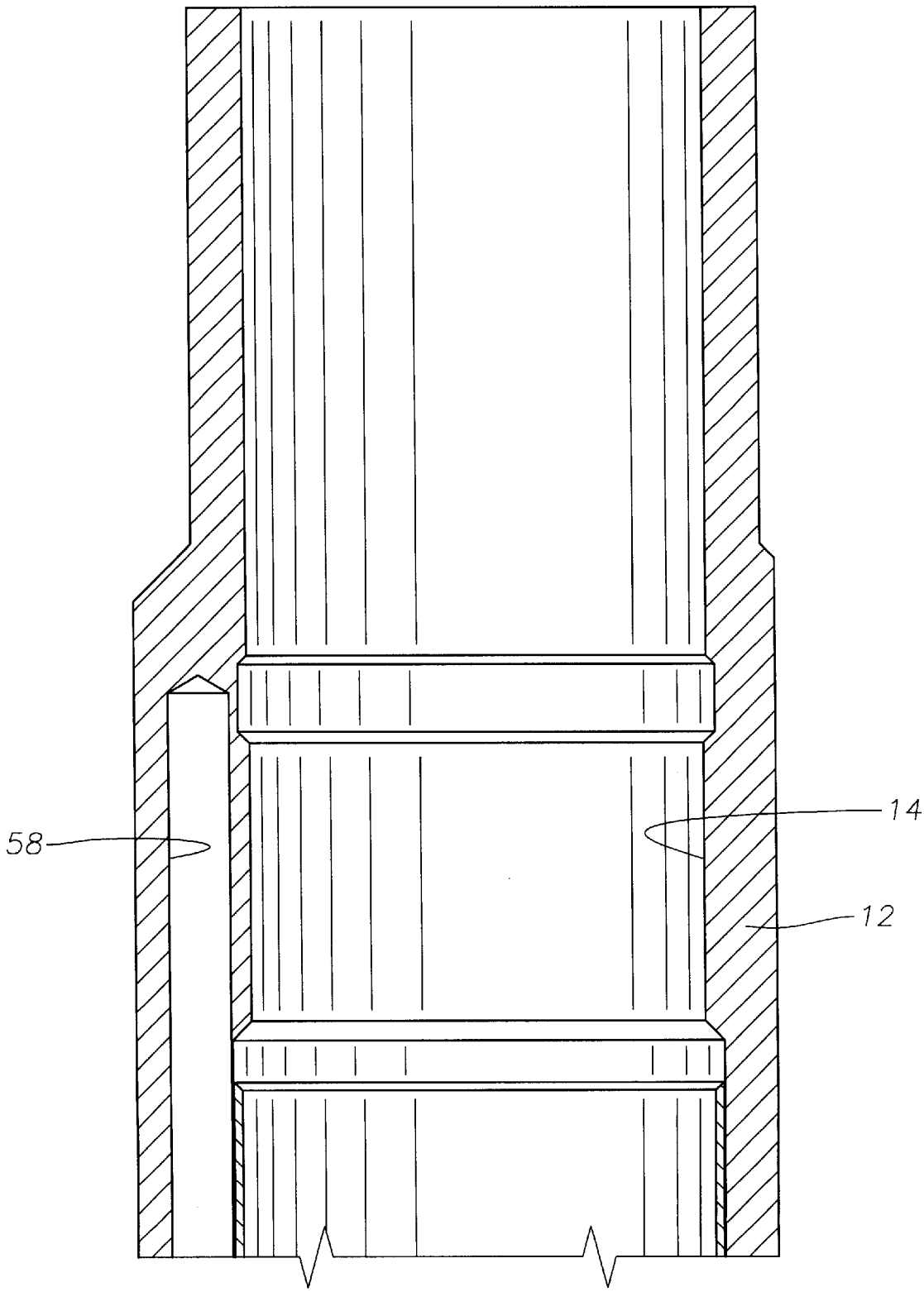
FIGS. 13A–13D, taken together, represent an enlargement of FIG. 5B.
Figure 13B:
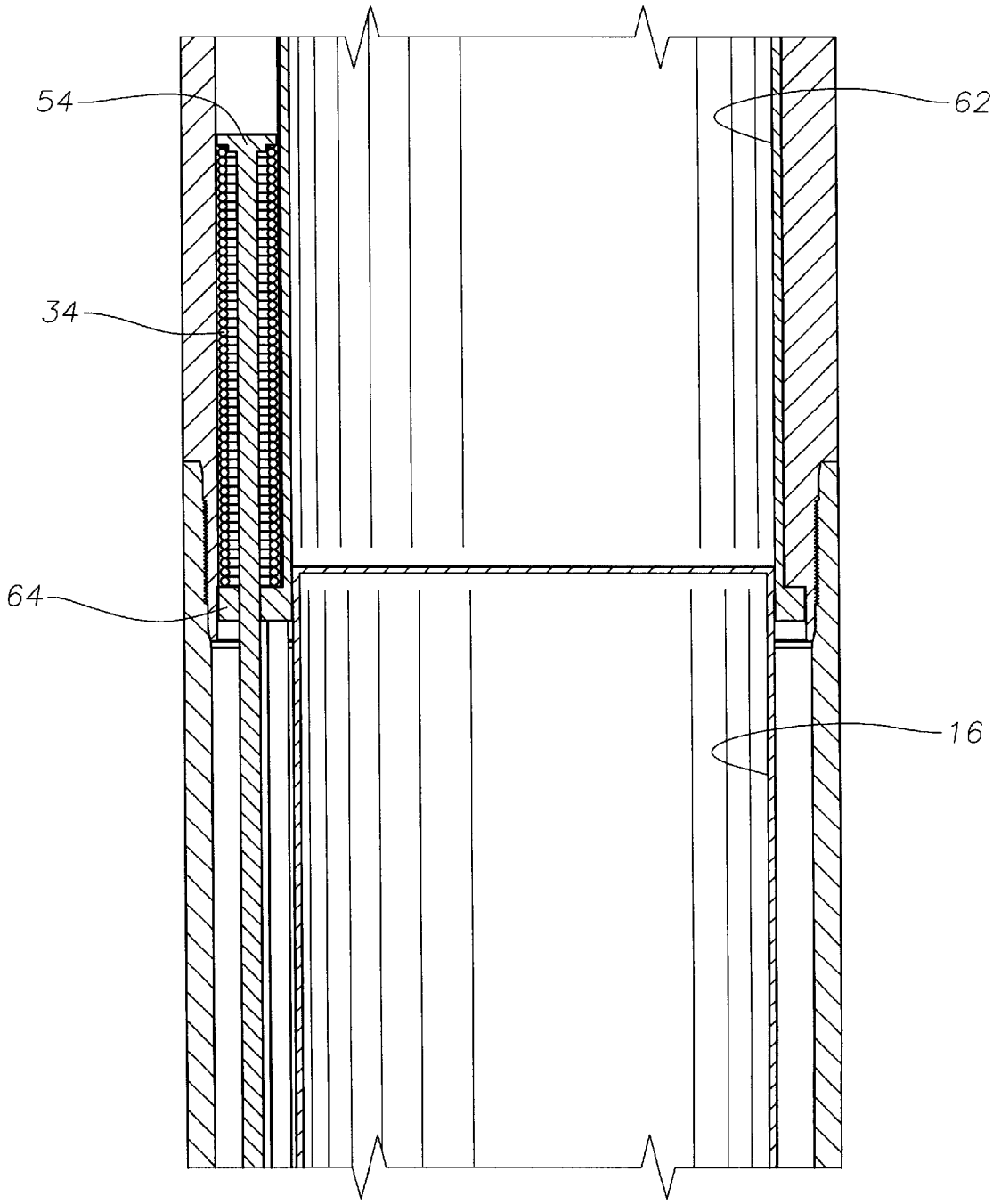
Figure 13C:
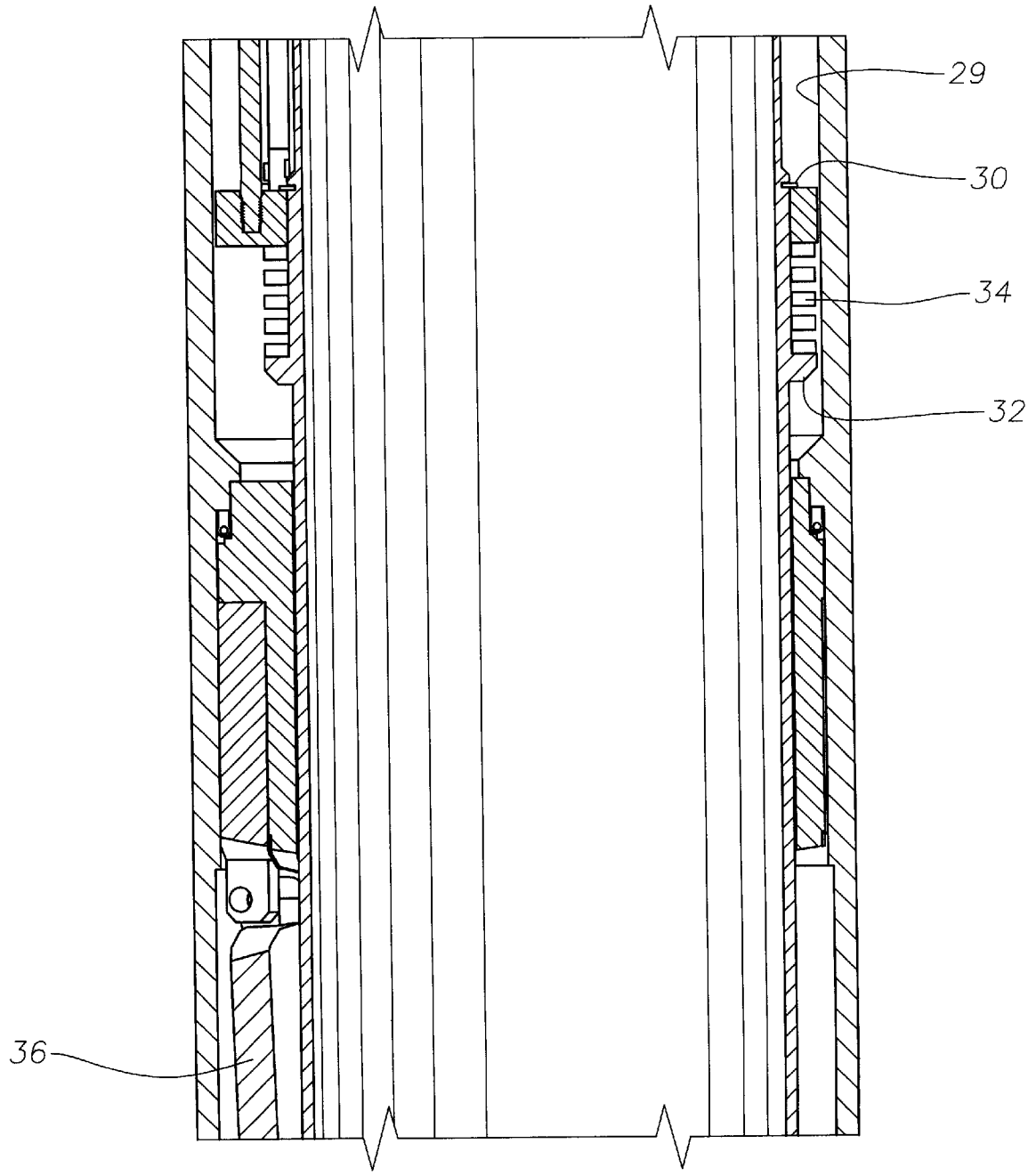
Figure 13D:
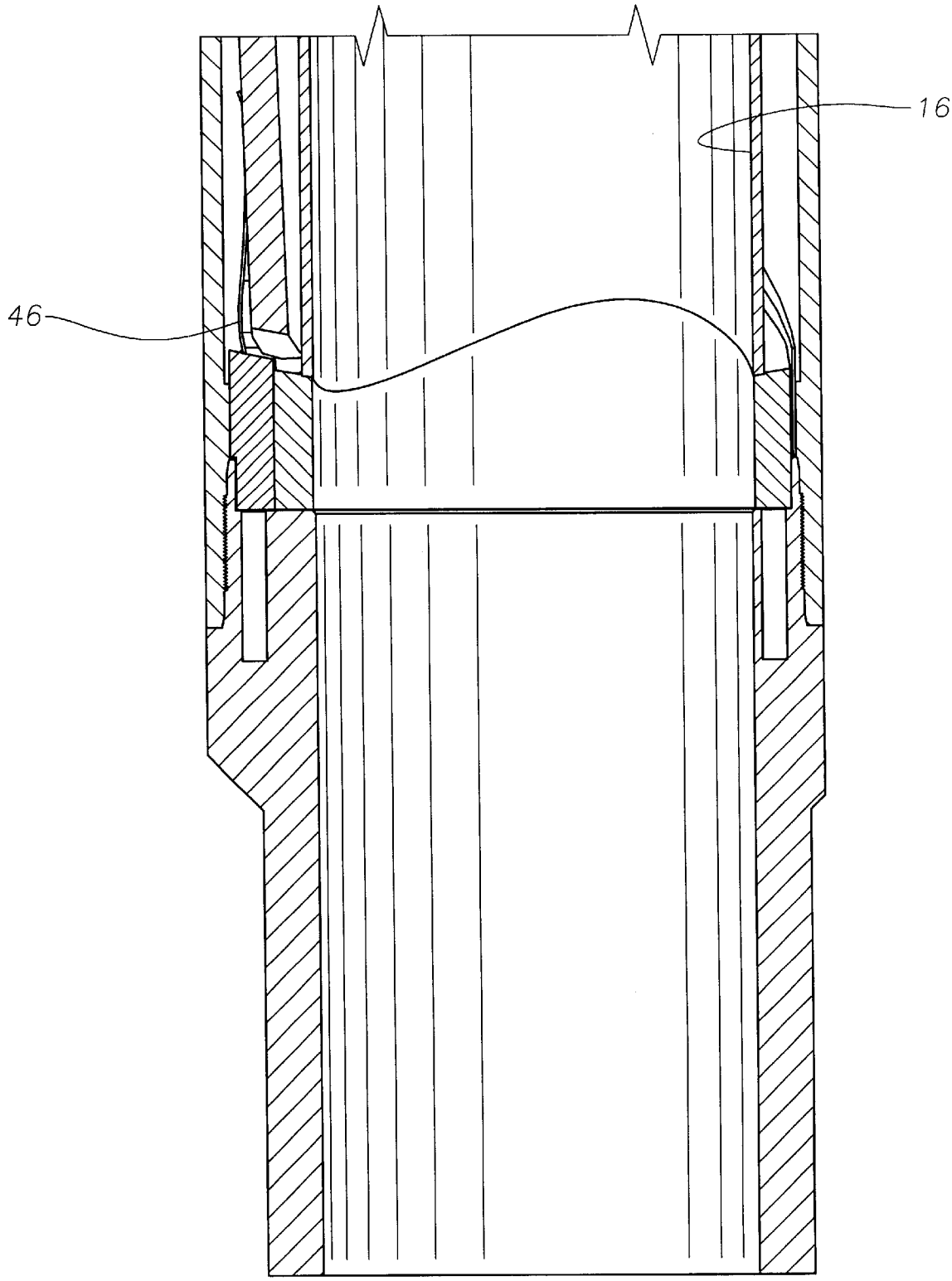

With reference to FIGS. 4A and 4B, the valve 10 may further include a longitudinal fluid passageway 68 through which various fluids (e.g., hydraulic fluid, injection chemicals, etc.) may be passed from a first end 70 of the valve 10 to a second end 72 the valve 10. The passageway 68 is preferably disposed on the thick side of the eccentric body 12. The fluid passageway 68 may be a continuous section of control conduit extending from the earth's surface and terminating at the second end 72 of the valve 10, such as at terminating end 74 as shown in FIG. 11D. The terminating end 74 may be connected to another section of control conduit 76 by a novel, all-metal connection 78, which will be the subject of a related patent.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. An eccentric subsurface safety valve for controlling fluid flow in a well conduit, comprising:

an eccentric body member having a thick side, a thin side, and a longitudinal bore extending therethrough;

a curved closure member mounted within the body member to control fluid flow through the longitudinal bore, and movably disposed between an open and a closed position; and a valve actuator movably disposed within the body member and remotely shiftable to move the closure member between open and closed positions.

2. The eccentric subsurface safety valve of claim 1, further including a piston movably disposed within the valve in response to pressurized fluid, and adapted to shift the closure member between its open and closed positions.

3. The eccentric subsurface safety valve of claim 2, wherein the piston is movably disposed within a cylinder disposed in the eccentric body member.

4. The eccentric subsurface safety valve of claim 3, wherein the cylinder is disposed in the thick side of the eccentric body member.

5. The eccentric subsurface safety valve of claim 2, further including a spring adapted to bias the piston away from the closure member.

6. The eccentric subsurface safety valve of claim 2, further including a volume of pressurized gas adapted to bias the piston away from the closure member.

7. The eccentric subsurface safety valve of claim 2, wherein the piston is connected to an eccentric plate movably disposed in a plate recess in the body member.

8. The eccentric subsurface safety valve of claim 7, wherein the eccentric plate is fixedly connected to the valve actuator.

9. The eccentric subsurface safety valve of claim 7, wherein the eccentric plate is slidably disposed about the valve actuator and between a first and a second shoulder on the valve actuator.

10. The eccentric subsurface safety valve of claim 9, further including a glide spring disposed about the valve actuator and between the eccentric plate and one of the first and second shoulders on the valve actuator.

11. The eccentric subsurface safety valve of claim 10, wherein the glide spring is a wave spring.

12. The eccentric subsurface safety valve of claim 7, further including:

at least one return spring rod having a first end and second end, the first end having a retaining flange, the second end being connected to the eccentric plate; and at least one return spring disposed about the at least one return spring rod and adapted to bias the piston away from the closure member.

13. The eccentric subsurface safety valve of claim 12, wherein the at least one return spring is contained between the retaining flange and a locking flange on a lockout sleeve disposed in the longitudinal bore of the eccentric body.

14. The eccentric subsurface safety valve of claim 13, wherein the locking flange includes a plurality of openings through which the piston and at least one return spring rod pass.

15. The eccentric subsurface safety valve of claim 12, wherein the at least one return spring is further contained within at least one spring bore disposed in the eccentric body member.

16. The eccentric subsurface safety valve of claim 15, wherein the at least one spring bore is disposed within the thick side of the eccentric body member.

17. The eccentric subsurface safety valve of claim 1, wherein the closure member is a curved flapper.

18. The eccentric subsurface safety valve of claim 1, wherein the valve actuator is a tubular sleeve.

19. The eccentric subsurface safety valve of claim 1, further including a longitudinal fluid passageway extending from a first to a second end of the body member.

20. The eccentric subsurface safety valve of claim 1, wherein the closure member is disposed within a recess in the thick side of the eccentric body when in the open position.

21. An eccentric subsurface safety valve for controlling fluid flow in a well conduit, comprising:

an eccentric body member having a thick side, a thin side., and a longitudinal bore extending therethrough, the thick and thin sides being separated by a line of asymmetry;

a curved closure member mounted within the body member to control fluid flow through the longitudinal bore, and movably disposed between an open and a closed position;

a valve actuator movably disposed within the body member and remotely shiftable to move the closure member between open and closed positions; and a piston engaged with the valve actuator and movably disposed within a cylinder in the eccentric body member in response to pressurized fluid.

22. The eccentric subsurface safety valve of claim 21, wherein the cylinder is disposed in the thick side of the eccentric body member.

23. The eccentric subsurface safety valve of claim 21, further including a spring adapted to bias the piston away from the closure member.

24. The eccentric subsurface safety valve of claim 21, further including a volume of pressurized gas adapted to bias the piston away from the closure member.

25. The eccentric subsurface safety valve of claim 21, wherein the piston is connected to an eccentric plate movably disposed in a plate recess in the body member.

26. The eccentric subsurface safety valve of claim 25, wherein the eccentric plate is fixedly connected to the valve actuator.

27. The eccentric subsurface safety valve of claim 25, wherein the eccentric plate is slidably disposed about the valve actuator and between a first and a second shoulder on the valve actuator.

28. The eccentric subsurface safety valve of claim 27, further including a glide spring disposed about the valve actuator and between the eccentric plate and one of the first and second shoulders on the valve actuator.

29. The eccentric subsurface safety valve of claim 28, wherein the glide spring is a wave spring.

30. The eccentric subsurface safety valve of claim 25, further including:

at least one return spring rod having a first end and second end, the first end having a retaining flange, the second end being connected to the eccentric plate; and at least one return spring disposed about the at least one return spring rod and adapted to bias the piston away from the closure member.

31. The eccentric subsurface safety valve of claim 30, wherein the at least one return spring is contained between the retaining flange and a locking flange on a lockout sleeve disposed in the longitudinal bore of the eccentric body.

32. The eccentric subsurface safety valve of claim 31, wherein the locking flange includes a plurality of openings through which the piston and at least one return spring rod pass to permit connection of the piston and at least one return spring rod to the eccentric plate.

33. The eccentric subsurface safety valve of claim 31, wherein the at least one return spring is further contained within at least one spring bore disposed in the eccentric body member.

34. The eccentric subsurface safety valve of claim 33, wherein the at least one spring bore is disposed within the thick side of the eccentric body member.

35. The eccentric subsurface safety valve of claim 21, wherein the closure member is a curved flapper.

36. The eccentric subsurface safety valve of claim 21, wherein the valve actuator is a tubular sleeve.

37. The eccentric subsurface safety valve of claim 21, wherein the closure member is disposed within a recess in the thick side of the eccentric body when in the open position.

38. An eccentric subsurface safety valve for controlling fluid flow in a well conduit, comprising:

an eccentric body member having a thick side, a thin side, and a longitudinal bore extending therethrough;

a curved closure member mounted within the body member to control fluid flow through the longitudinal bore, and movably disposed between an open and a closed position; and means for remotely shifting the closure member between open and closed positions.

39. The eccentric subsurface safety valve of claim 38, wherein the remote-shifting means includes a valve actuator movably disposed within the body member and remotely shiftable to move the closure member between open and closed positions and a piston movably disposed in response to pressurized fluid and adapted to shift the closure member between its open and closed positions.

40. The eccentric subsurface safety valve of claim 39, further including means for biasing the valve actuator away from the closure member.

41. The eccentric subsurface safety valve of claim 38, wherein the closure member is disposed within a recess in the thick side of the eccentric body when in the open position.

42. A method of increasing an inside diameter of a subsurface safety valve without increasing an outside diameter of the subsurface safety valve, comprising:

providing an eccentric body member having a thick side, a thin side, and a longitudinal bore extending therethrough;

movably mounting a curved closure member within the body member to control fluid flow through the longitudinal bore, the closure member being movable between closed and open positions;

disposing the closure member in a recess in the body member when the closure member is in its open position; and using the thick side of the body member to house at least one component of a mechanism for remotely shifting the closure member between its open and closed positions.

43. An eccentric subsurface safety valve for controlling fluid flow in a well conduit, comprising:

an eccentric body member having a thick side, a thin side, and a longitudinal bore extending therethrough;

a closure member mounted within the body member to control fluid flow through the longitudinal bore, and movably disposed between an open and a closed position;

a valve actuator movably disposed within the body member and remotely shiftable to move the closure member between open and closed positions; and the valve actuator mating with the closure member when the closure member is in the closed position.

44. An eccentric subsurface safety valve as in claim 43, wherein:

the closure member includes an upper surface that is contoured;

the valve actuator includes a lower surface that is contoured; and the valve actuator lower surface mates with the closure member upper surface when the closure member is in the closed position.

45. An eccentric subsurface safety valve as in claim 44, wherein the valve actuator mates with a contoured sealing surface located on the body member when the closure member is in the open position.

46. An eccentric subsurface safety valve as in claim 45, wherein the contoured sealing surface is mounted below the closure member.

47. An eccentric subsurface safety valve as in claim 43, wherein the valve actuator mates with a sealing surface located on the body member when the closure member is in the open position.

48. An eccentric subsurface safety valve for controlling fluid flow in a well conduit, comprising:

an eccentric body member having a thick side, a thin side, and a longitudinal bore extending therethrough;

a closure member mounted within the body member to control fluid flow through the longitudinal bore, and movably disposed between an open and a closed position;

a valve actuator movably disposed within the body member and remotely shiftable to move the closure member between open and closed positions; and the valve actuator mating with a sealing surface located on the body member when the closure member is in the open position.

49. An eccentric subsurface safety valve as in claim 48, wherein:

the valve actuator includes a lower surface that is contoured;

the sealing surface is contoured in shape;

the valve actuator lower surface mates with the contoured sealing surface when the closure member is in the closed position.

50. An eccentric subsurface safety valve as in claim 49, wherein the contoured sealing surface is mounted below the closure member.

51. An eccentric subsurface safety valve for controlling fluid flow in a well conduit, comprising:

a body member having a thick side, a thin side, and a longitudinal bore extending therethrough;

a curved closure member eccentrically mounted within the body member to control fluid flow through the longitudinal bore, and movably disposed between an open and a closed position; and a valve actuator movably disposed within the body member and remotely shiftable to move the closure member between open and closed positions.

* * * * *